US009041749B2

(12) United States Patent
Murayama

(10) Patent No.: US 9,041,749 B2
(45) Date of Patent: May 26, 2015

(54) METHOD FOR DRIVING ELECTROPHORETIC DISPLAY DEVICE, ELECTROPHORETIC DISPLAY DEVICE, ELECTRONIC APPARATUS, AND ELECTRONIC TIMEPIECE

(71) Applicant: Seiko Epson Corporation, Tokyo (JP)

(72) Inventor: Tetsuro Murayama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 96 days.

(21) Appl. No.: 14/015,415

(22) Filed: Aug. 30, 2013

(65) Prior Publication Data

US 2014/0071183 A1 Mar. 13, 2014

(30) Foreign Application Priority Data

Sep. 11, 2012 (JP) ..... 2012-199616

(51) Int. Cl.

| | |
|---|---|
| ***G09G 5/10*** | (2006.01) |
| ***G09G 3/34*** | (2006.01) |
| ***G09G 3/20*** | (2006.01) |

(52) U.S. Cl.

CPC ..... *G09G 3/344* (2013.01); *G09G 3/2011* (2013.01); *G09G 3/2014* (2013.01); *G09G 3/2081* (2013.01); *G09G 2310/061* (2013.01); *G09G 2310/068* (2013.01); *G09G 2320/0204* (2013.01); *G09G 2320/041* (2013.01); *G09G 2320/043* (2013.01)

(58) Field of Classification Search

CPC ... G09G 3/344; G09G 3/2011; G09G 3/2014; G09G 3/2018; G09G 2320/043; G09G 2310/068

See application file for complete search history.

(56) References Cited

U.S. PATENT DOCUMENTS

| | | | | |
|---|---|---|---|---|
| 7,012,600 | B2 | 3/2006 | Zehner et al. | |
| 7,623,113 | B2 | 11/2009 | Zhou et al. | |
| 8,081,155 | B2 | 12/2011 | Kajino | |
| 8,237,653 | B2 | 8/2012 | Maeda et al. | |
| 8,319,726 | B2 | 11/2012 | Kajino | |
| 2006/0284794 | A1 | 12/2006 | Johnson et al. | |
| 2007/0052648 | A1 | 3/2007 | Zhou et al. | |
| 2007/0057905 | A1 | 3/2007 | Johnson et al. | |
| 2007/0080926 | A1 | 4/2007 | Zhou et al. | |
| 2007/0080927 | A1 | 4/2007 | Zhou et al. | |
| 2011/0115759 | A1 * | 5/2011 | Yamazaki | 345/204 |

FOREIGN PATENT DOCUMENTS

| | | | |
|---|---|---|---|
| JP | 2005-530201 | A | 10/2005 |
| JP | 2007-505340 | A | 3/2007 |
| JP | 2007-505348 | A | 3/2007 |
| JP | 2007-505351 | A | 3/2007 |

(Continued)

*Primary Examiner* — Premal Patel
(74) *Attorney, Agent, or Firm* — Global IP Counselors, LLP

(57) ABSTRACT

A method includes: causing a first image to be displayed in a first color by a partial drive format; causing a background of the first image to be displayed in the first color; causing a background of a second image to be displayed in a second color; and causing the second image to be displayed in the second color. In a case where a temperature detection unit detects a predetermined change in temperature after causing a background of a second image to be displayed in a second color and before causing the second image to be displayed in the second color, then causing a predetermined image to be displayed and causing the predetermined image to be complementarily displayed using a drive pulse signal adjusted for the temperature after the change.

9 Claims, 21 Drawing Sheets

(56) References Cited

FOREIGN PATENT DOCUMENTS

| | | | |
|---|---|---|---|
| JP | 2007-506127 | A | 3/2007 |
| JP | 2007-512567 | A | 5/2007 |
| JP | 2007-512571 | A | 5/2007 |
| JP | 2009-229912 | A | 10/2009 |
| JP | 2009-236603 | A | 10/2009 |
| JP | 2009-258614 | A | 11/2009 |
| JP | 2010-044397 | A | 2/2010 |
| JP | 2010-256516 | A | 11/2010 |
| JP | 2012-108417 | A | 6/2012 |
| JP | 2013-061592 | A | 4/2013 |
| JP | 2013-130620 | A | 7/2013 |

* cited by examiner

Fig. 7A
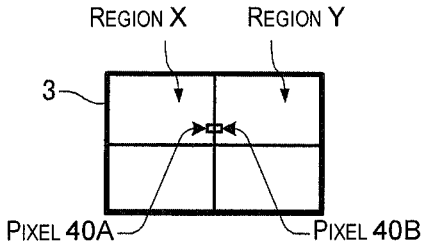
Fig. 7B
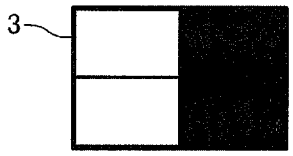
Fig. 7C
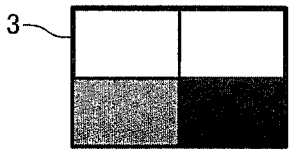
Fig. 7D
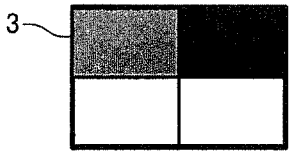
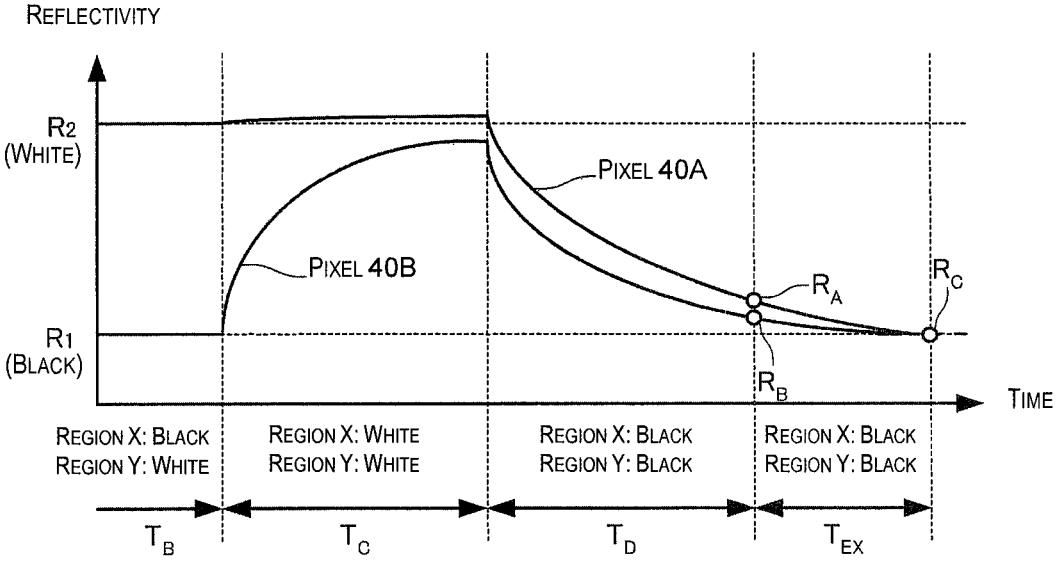
Fig. 7E

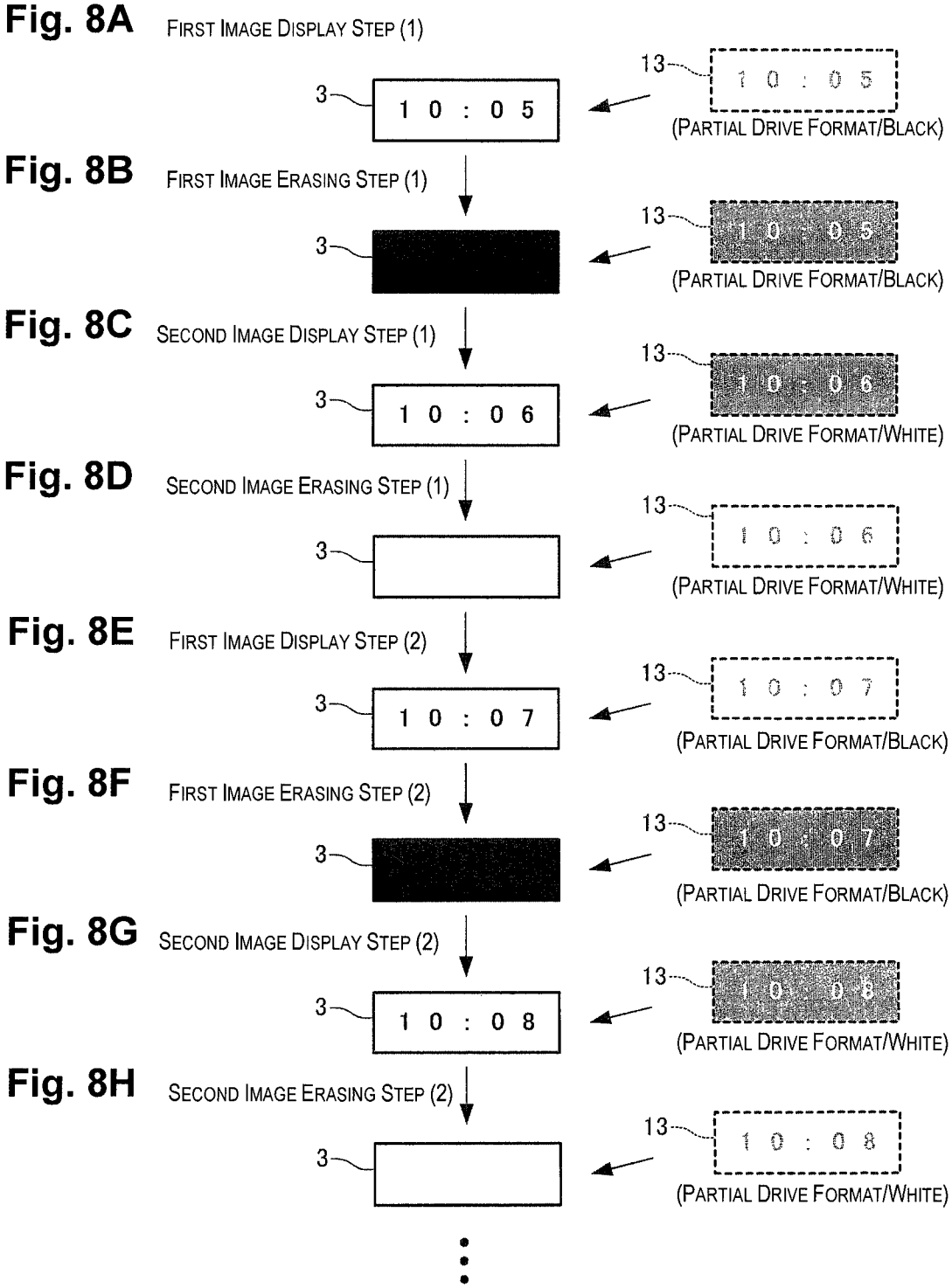
Fig. 8A
FIRST IMAGE DISPLAY STEP (1)
3
10 : 05
13
10 : 05
(PARTIAL DRIVE FORMAT/BLACK)
Fig. 8B
FIRST IMAGE ERASING STEP (1)
3
13
10 : 05
(PARTIAL DRIVE FORMAT/BLACK)
Fig. 8C
SECOND IMAGE DISPLAY STEP (1)
3
10 : 06
13
10 : 06
(PARTIAL DRIVE FORMAT/WHITE)
Fig. 8D
SECOND IMAGE ERASING STEP (1)
3
13
10 : 06
(PARTIAL DRIVE FORMAT/WHITE)
Fig. 8E
FIRST IMAGE DISPLAY STEP (2)
3
10 : 07
13
10 : 07
(PARTIAL DRIVE FORMAT/BLACK)
Fig. 8F
FIRST IMAGE ERASING STEP (2)
3
13
10 : 07
(PARTIAL DRIVE FORMAT/BLACK)
Fig. 8G
SECOND IMAGE DISPLAY STEP (2)
3
10 : 08
13
10 : 08
(PARTIAL DRIVE FORMAT/WHITE)
Fig. 8H
SECOND IMAGE ERASING STEP (2)
3
13
10 : 08
(PARTIAL DRIVE FORMAT/WHITE)

| TEMPERATURE (°C) | T1 (ms) | T2 (ms) | AMPLITUDE (V) | (NUMBER OF) REPETITIONS |
|---|---|---|---|---|
| 4 ~ 9 | 110 | 10 | 15 | 6 |
| 10 ~ 13 | 90 | 10 | 15 | 6 |
| 14 ~ 16 | 90 | 10 | 15 | 5 |
| 17 ~ 20 | 90 | 10 | 15 | 4 |

Fig. 9

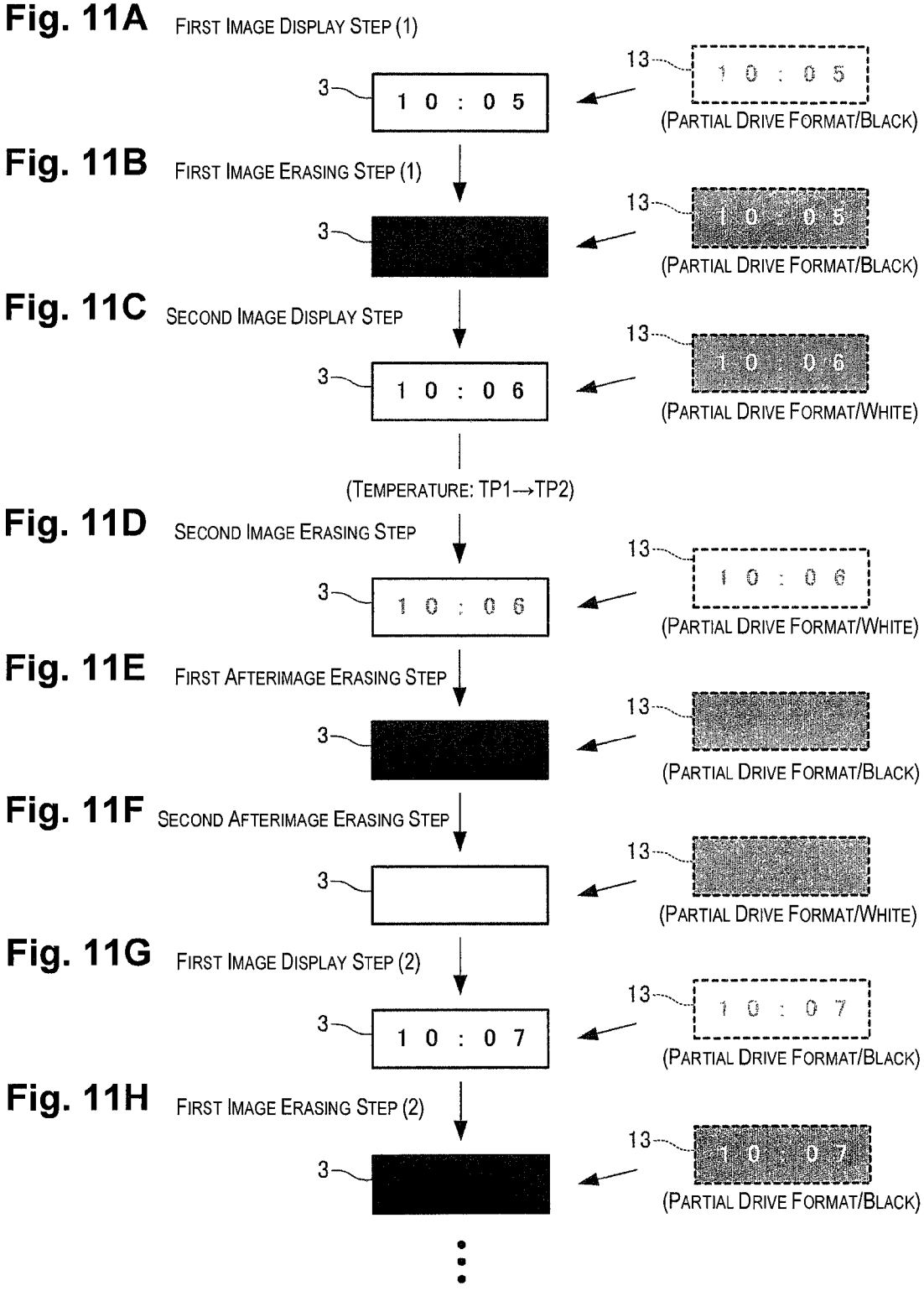
Fig. 11A
FIRST IMAGE DISPLAY STEP (1)
3
10 : 05
13
10 : 05
(PARTIAL DRIVE FORMAT/BLACK)
Fig. 11B
FIRST IMAGE ERASING STEP (1)
3
13
10 : 05
(PARTIAL DRIVE FORMAT/BLACK)
Fig. 11C
SECOND IMAGE DISPLAY STEP
3
10 : 06
13
10 : 06
(PARTIAL DRIVE FORMAT/WHITE)
(TEMPERATURE: TP1→TP2)
Fig. 11D
SECOND IMAGE ERASING STEP
3
10 : 06
13
10 : 06
(PARTIAL DRIVE FORMAT/WHITE)
Fig. 11E
FIRST AFTERIMAGE ERASING STEP
3
13
(PARTIAL DRIVE FORMAT/BLACK)
Fig. 11F
SECOND AFTERIMAGE ERASING STEP
3
13
(PARTIAL DRIVE FORMAT/WHITE)
Fig. 11G
FIRST IMAGE DISPLAY STEP (2)
3
10 : 07
13
10 : 07
(PARTIAL DRIVE FORMAT/BLACK)
Fig. 11H
FIRST IMAGE ERASING STEP (2)
3
13
10 : 07
(PARTIAL DRIVE FORMAT/BLACK)

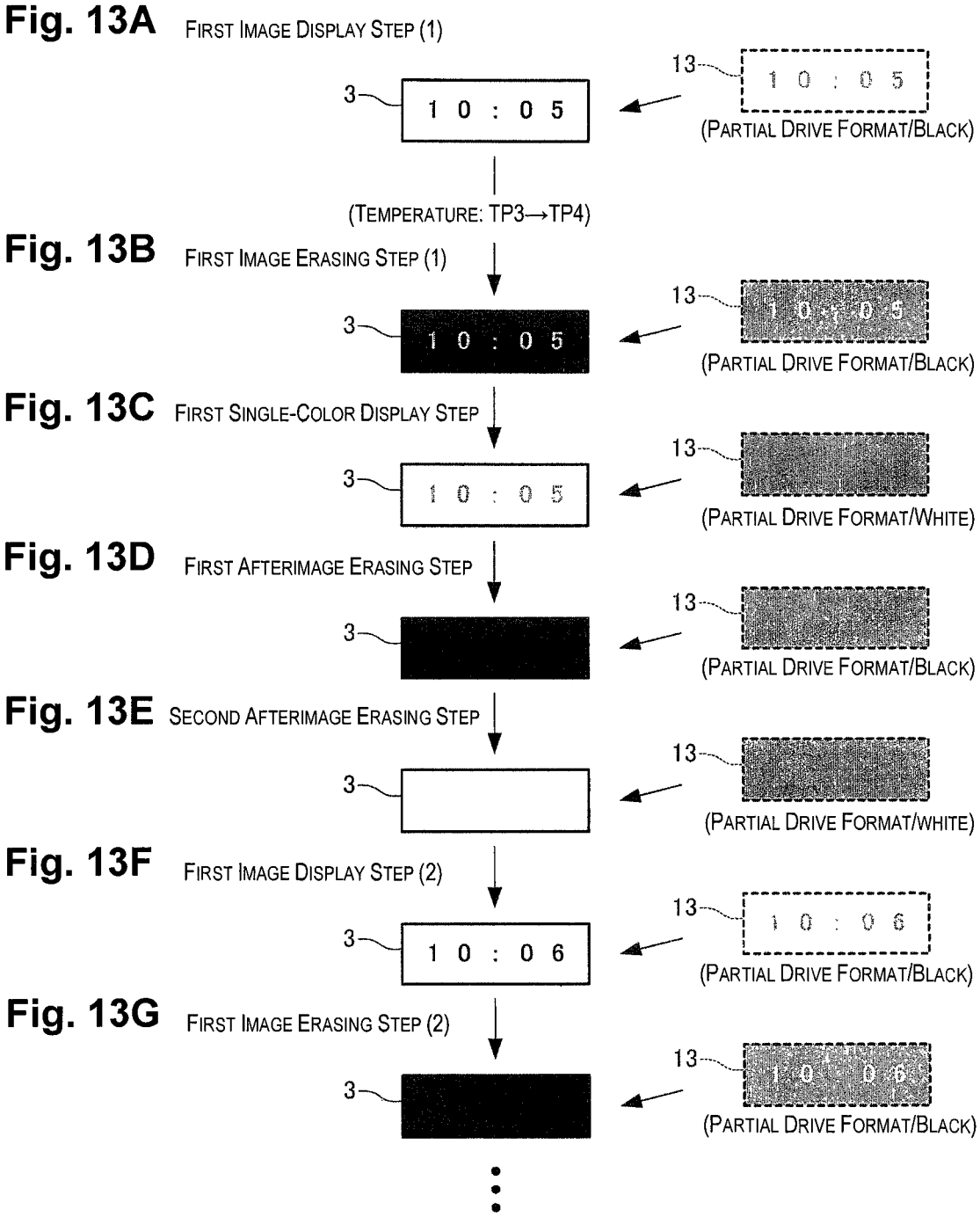
Fig. 13A
FIRST IMAGE DISPLAY STEP (1)
3
10 : 05
13
10 : 05
(PARTIAL DRIVE FORMAT/BLACK)
(TEMPERATURE: TP3→TP4)
Fig. 13B
FIRST IMAGE ERASING STEP (1)
3
10 : 05
13
10 : 05
(PARTIAL DRIVE FORMAT/BLACK)
Fig. 13C
FIRST SINGLE-COLOR DISPLAY STEP
3
10 : 05
13
(PARTIAL DRIVE FORMAT/WHITE)
Fig. 13D
FIRST AFTERIMAGE ERASING STEP
3
13
(PARTIAL DRIVE FORMAT/BLACK)
Fig. 13E
SECOND AFTERIMAGE ERASING STEP
3
13
(PARTIAL DRIVE FORMAT/WHITE)
Fig. 13F
FIRST IMAGE DISPLAY STEP (2)
3
10 : 06
13
10 : 06
(PARTIAL DRIVE FORMAT/BLACK)
Fig. 13G
FIRST IMAGE ERASING STEP (2)
3
13
10 : 06
(PARTIAL DRIVE FORMAT/BLACK)

CHECKERED PATTERN (NORMAL)

CHECKERED PATTERN (INVERSE)

HOUNDSTOOTH CHECK (NORMAL)

HOUNDSTOOTH CHECK (INVERSE)

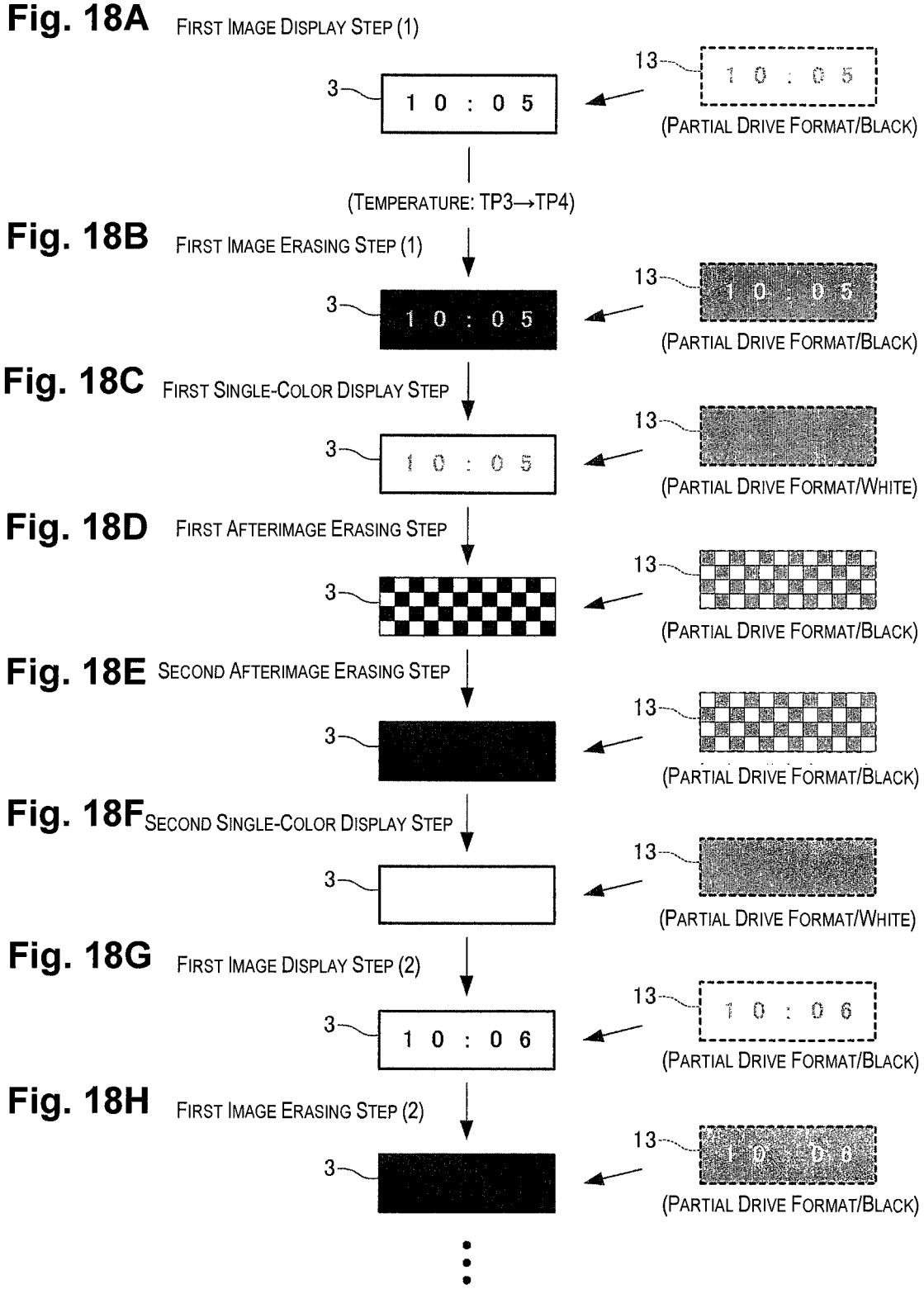
Fig. 18A
FIRST IMAGE DISPLAY STEP (1)
3
10 : 05
13
10 : 05
(PARTIAL DRIVE FORMAT/BLACK)
(TEMPERATURE: TP3→TP4)
Fig. 18B
FIRST IMAGE ERASING STEP (1)
3
10 : 05
13
10 : 05
(PARTIAL DRIVE FORMAT/BLACK)
Fig. 18C
FIRST SINGLE-COLOR DISPLAY STEP
3
10 : 05
13
(PARTIAL DRIVE FORMAT/WHITE)
Fig. 18D
FIRST AFTERIMAGE ERASING STEP
3
13
(PARTIAL DRIVE FORMAT/BLACK)
Fig. 18E
SECOND AFTERIMAGE ERASING STEP
3
13
(PARTIAL DRIVE FORMAT/BLACK)
Fig. 18F
SECOND SINGLE-COLOR DISPLAY STEP
3
13
(PARTIAL DRIVE FORMAT/WHITE)
Fig. 18G
FIRST IMAGE DISPLAY STEP (2)
3
10 : 06
13
10 : 06
(PARTIAL DRIVE FORMAT/BLACK)
Fig. 18H
FIRST IMAGE ERASING STEP (2)
3
13
10 : 06
(PARTIAL DRIVE FORMAT/BLACK)

METHOD FOR DRIVING ELECTROPHORETIC DISPLAY DEVICE, ELECTROPHORETIC DISPLAY DEVICE, ELECTRONIC APPARATUS, AND ELECTRONIC TIMEPIECE

CROSS-REFERENCE TO RELATED APPLICATIONS

This application claims priority to Japanese Patent Application No. 2012-199616 filed on Sep. 11, 2012. The entire disclosure of Japanese Patent Application No. 2012-199616 is hereby incorporated herein by reference.

BACKGROUND

1. Technical Field

The present invention relates to a method for driving an electrophoretic display device, an electrophoretic display device, an electronic apparatus, an electronic timepiece, and the like.

2. Background Technology

In recent years, display panels having a memory property whereby an image can be displayed even when the power is turned off have been developed, and have been put to use in electronic apparatuses such as electronic timepieces. Electrophoretic display devices (EDD), memory liquid crystal display devices, and the like are known display panels having a memory property.

Electrophoretic display devices have the advantage of being excellent in terms of wide viewing angle, high contrast ratio, flexibility, low power consumption, and so forth. An electrophoretic display device displays an image by using an applied electric field to move, for example, white and black charged electrophoretic particles. The charged particles move through a dispersion solution; however, for example, the viscosity of the dispersion solution is temperature-dependent. For this reason, a change in temperature can sometimes result in a display image appearing differently, even when an identical electric field is applied.

In view whereof, for example, the invention of Patent Document 1 changes the durations of a reset pulse and a drive pulse on the basis of the temperature. So doing compensates for the effects of temperature changes and achieves an improvement in the image quality.

Japanese Laid-open Patent Publication No. 2007-505351 (national-phase translation of international application, Patent Document 1) and Japanese Laid-open Patent Publication No. 2005-530201 (national-phase translation of international application, Patent Document 2) are examples of the related art.

SUMMARY

Problem to be Solved by the Invention

However, as is described in Patent Document 2, a concern also arises in that in an electrophoretic display device, when the time average of the electric field applied between the electrodes is not substantially zero, the operating life of the device will be shorter. In other words, ensuring the long-term reliability of an electrophoretic display device necessitates striking a DC balance, i.e., having the time average of the electric field being applied be substantially zero.

However, in the invention in Patent Document 1, the duration of the drive pulse and the duration of the reset pulse are established on the basis of scaling functions which are each independent. Accordingly, a deviation arises in the direction and magnitude of the electric field being applied between the electrodes, and thus in the invention in Patent Document 1, it is difficult to ensure the long-term reliability of the electrophoretic display device.

A separate problem suffered in the invention in Patent Document 1 is that even were the durations of the reset pulse and the drive pulse to be identical, the refresh time for an image would be increased. An electrophoretic display device is able to display an image in either a full-screen drive format, in which the entirety of a display unit is rendered, or a partial drive format, which also allows for rendering of a part that is intended to be written over. The invention in Patent Document 1 is premised on the full-screen drive format, and the refresh time for an image is so remarkably delayed as to not be practical when the durations for the reset pulse and the drive pulse are aligned, i.e., matched to the longer of the durations.

The invention has been contrived in view of the problems of such description. According to several aspects of the invention, provided is, inter alia, a method for driving an electrophoretic display device making it possible to use a partial drive format, which allows for a shorter refresh time for an image, to also compensate for the effects of temperature changes while still striking a DC balance.

Means for Solving Problem

A first aspect of the invention is a method for driving an electrophoretic display device. The display includes a display unit in which electrophoretic elements including electrophoretic particles are sandwiched between a pair of substrates and which includes pixels capable of displaying at least a first color and a second color, pixel electrodes corresponding to the pixels disposed between the substrates and the electrophoretic elements, a common electrode that faces the plurality of pixel electrodes disposed between the other of the substrates and the electrophoretic elements, and a temperature detection unit configured to measure a temperature of the display unit.

The method includes:

causing the display unit to display a first image in the first color by a partial drive format, in which a voltage based on a drive pulse signal repeating a first electric potential and a second electric potential is applied to the common electrode and a voltage based on a normal signal or an inverse signal of the drive pulse signal is applied to each of the plurality of pixel electrodes, thus causing the electrophoretic particles to be moved by an electric field produced between the pixel electrodes and the common electrode;

causing the display unit to display a background of the first image in the first color by the partial drive format, after the causing the display unit to display the first image in the first color;

causing the display unit to display a background of a second image in the second color, by the partial drive format; and causing the display unit to display the second image in the second color by the partial drive format, after the causing the display unit to display the background of the second image; and wherein in a case where the temperature detection unit detects a predetermined change in temperature after the causing the display unit to display the background of the second image and before the casing the display unit to display the second image in the second color, causing the display unit to display a predetermined image by using the drive pulse signal adjusted on the basis of a temperature after the change, and causing the display unit to complementarily display the predetermined image by using the drive pulse signal adjusted on the basis of the temperature after the change, are executed after the causing the display unit to display the second image in the second color, and a subsequent iteration of the causing the display unit to display the first image in the first color is executed after the causing the display unit to complementarily display the predetermined image.

According to the invention, at least four steps are executed by the partial drive format. The four steps are the first image display step for causing the first image to be displayed in the first color, the first image erasing step for causing the background of the first image to be displayed in the first color, the second image display step for causing the background of the second image to be displayed in the second color, and the second image erasing step for causing the second image to be displayed in the second color.

The electrophoretic display device for carrying out the method of driving of the invention includes the temperature detection unit for detecting a change in temperature of the display unit. The temperature detection unit includes, for example, a temperature sensor for detecting the temperature of the display unit. The temperature sensor can measure the temperature directly, by contact with the display unit, or can be arranged in the vicinity of the display unit and establish the temperature by, for example, a calculation. The temperature detection unit detects whether or not there is a predetermined change in temperature (for example, a change of 3° or more) on the basis of the temperature of the display unit received from the temperature sensor.

According to the invention, the first afterimage erasing step and the second afterimage erasing step are executed in a case where the temperature detection unit detects the predetermined change in temperature after the second image display step and before the second image erasing step. In other words, two steps in which the drive pulse signal that has been adjusted on the basis of the temperature after the change are added after the four steps in which the drive pulse signal that has been adjusted on the basis of the temperature before the change is used. These two added steps makes it possible to remove the afterimage that can be produced by a change in temperature of the display unit and to compensate for the effects of the change in temperature. At this time, there is no need for the two additional steps to be executed immediately in a case where the temperature detection unit detects the predetermined change in temperature. For example, in an example of a time display described below (see FIG. 11), the first afterimage removing step and the second afterimage removing step are executed at a timing where the time is refreshed.

In the partial drive format, a voltage based on a drive pulse signal repeating a first electric potential and a second electric potential is applied to the common electrode and a voltage based on a normal signal or an inverse signal of the drive pulse signal is applied to each of the plurality of pixel electrodes, thus causing the electrophoretic particles to be moved by an electric field produced between the pixel electrodes and the common electrode and thereby writing over an image being displayed on the display unit. The partial drive format makes it possible to render not only the entirety of the display unit but also solely a part that is intended to be written over.

According to the invention, the first image display step, the first image erasing step, the second image display step, and the second image erasing step include rendering a part of the display unit by the partial drive format, and therefore a shorter refreshing time for the images is possible in comparison to a full-screen drive format in which the entirety of the display unit is rendered at all times. Preferably, the additionally executed first afterimage erasing step and second afterimage erasing step use the partial drive format, in order to shorten the refreshing time for the images, but it would also be possible to use the full-screen drive format.

In the method for driving an electrophoretic display device of the invention, in a case where the predetermined change in temperature is not detected, the entirety of the display unit is displayed in the first color in the first image display step and the first image erasing step in conjunction. Then, the entirety of the display unit is displayed in the second color in the second image display step and the second image erasing step in conjunction. For this reason, a DC balance can be struck among the four steps.

In a case where the predetermined change in temperature is detected, a DC balance can be struck between the first afterimage erasing step for causing the predetermined image to be displayed and the second afterimage erasing step for causing the predetermined image to be complementarily displayed. For example, the predetermined image is understood to be a single-color display in which the entirety of the display unit is the first color. At this time, the entirety of the display unit is the first color in the first afterimage erasing step, and is complementarily displayed in the second afterimage erasing step. "Complementary display" signifies in principle that a portion that was not displayed in the first color in the first afterimage erasing step would be displayed in the second color, but in a case where a single-color display of the first color is used, it would be exceptionally possible for the entirety of the display unit to be displayed in the second color. In other words, the entirety of the display unit is displayed inverted in the second afterimage erasing step, and therefore a DC balance can be struck between the two steps.

When the first afterimage erasing step and the second afterimage erasing step use the full-screen drive format, the predetermined image will be displayed inverted in the second afterimage erasing step, irrespective of what kind of image the predetermined image is, and thus a DC balance can be struck between these two steps.

Accordingly, the method for driving an electrophoretic display device of the invention makes it possible to also compensate for the effects of a change in temperature while still striking a DC balance. For this reason, the long-term reliability can be ensured, and the display quality is enhanced. Also, because the partial drive format is still used, it is possible to shorten the refresh time for an image in comparison to a case where solely the full-screen drive format is used.

The "first color" is, for example, black, and the "second color" is, for example, white. The first image and the second image are an image displayed on a part of the display unit, and can be either letters, numbers, text, figures, symbols, patterns, or the like, or a combination thereof. The first image and the second image can also change to different letters, numbers, text, figures, symbols, patterns, or the like every time a display is effected in the first image display step and the second image display step. The background of the first image and the background of the second image refer to portions other than the first image and portions other than the second image, respectively, on the display unit.

A second aspect of the invention is a method for driving an electrophoretic display device including a display unit in which electrophoretic elements including electrophoretic particles are sandwiched between a pair of substrates and which includes pixels capable of displaying at least a first color and a second color, pixel electrodes corresponding to the pixels disposed between one of the substrates and the electrophoretic elements and a common electrode that faces the plurality of pixel electrodes disposed between the other of the substrates and the electrophoretic elements, and a temperature detection unit configured to measure a temperature of the display unit, wherein the method includes:

causing the display unit to display a first image in the first color by a partial drive format, in which a voltage based on a drive pulse signal repeating a first electric potential and a second electric potential is applied to the common electrode and a voltage based on a normal signal or an inverse signal of the drive pulse signal is applied to each of the plurality of pixel electrodes, thus causing the electrophoretic particles to be moved by an electric field produced between the pixel electrodes and the common electrode; and causing the display unit to display a background of the first image in the first color by the partial drive format, after the causing the display unit to display the first image in the first color; and wherein in a case where the temperature detection unit detects the predetermined change in temperature after the causing the display unit to display the first image in the first color and before the causing the display unit to display the background of the first image in the first color, causing all the pixels of the display unit to be displayed in the second color by using the drive pulse signal adjusted on the basis of the temperature before the change, causing the display unit to display a predetermined image by using the drive pulse signal adjusted on the basis of the temperature after the change, and causing the display unit to complementarily display the predetermined image by using the drive pulse signal adjusted on the basis of the temperature after the change, are executed after the causing the display unit to display the background of the first image in the first colort, and a subsequent iteration of the causing the display unit to display the first image in the first color is executed after the causing the display unit to complementarily display the predetermined image.

According to the invention, the first image display step for causing the first image to be displayed in the first color and the first image erasing step for causing the background of the first image to be displayed in the first color are executed by the partial drive format. The electrophoretic display device for carrying out the method of driving of the invention includes the temperature detection unit for detecting a change in temperature of the display unit, and detects whether or not there has been a predetermined change in temperature.

According to the invention, the first single-color display step, the first image erasing step, and the second image erasing step are executed in a case where the temperature detection unit detects the predetermined change in temperature after the first image display step and before the first image erasing step. In other words, the first single-color display step in which the drive pulse signal that has been adjusted on the basis of the temperature before the change is used and the two steps in which the drive pulse signal that has been adjusted on the basis of the temperature after the change is used (the first afterimage erasing step and the second afterimage erasing step) are added after the two steps in which the drive pulse signal that has been adjusted on the basis of the temperature before the change is used (the first image display step and the first image erasing step). These three added steps make it possible to remove the afterimage that can be produced by a change in temperature of the display unit and to compensate for the effects of the change in temperature, while still striking a DC balance. At this time, there is no need for the three additional steps to be executed immediately in a case where the temperature detection unit detects the predetermined change in temperature. For example, in an example of a time display described below (see FIG. 13), the first single-color display step, the first afterimage erasing step, and the second afterimage erasing step are executed at a timing where the time is refreshed.

According to the invention, the first image display step and the first image erasing step include rendering a part of the display unit by the partial drive format, and therefore a shorter refreshing time for the images is possible in comparison to a full-screen drive format in which the entirety of the display unit is rendered at all times. Herein, the first single-color display step requires that the entirety of display unit be set to the second color by the partial drive format in order to strike a DC balance. Preferably, the first afterimage erasing step and the second afterimage erasing step use the partial drive format, in order to shorten the refreshing time for the images, but it would also be possible to use the full-screen drive format.

In the method for driving an electrophoretic display device of the invention, the entirety of the display unit is displayed in the first color in the first image display step and the first image erasing step in conjunction. Then, in a case where the predetermined change in temperature is detected, the added first single-color display step includes displaying the entirety of the display unit in the second color, and therefore a DC balance can be struck among these three steps. As stated earlier, a DC balance can also be struck between the first afterimage erasing step and the second afterimage erasing step.

In a case where the predetermined change in temperature is not detected, then a step for causing the entirety of the display unit to be displayed in the second color should be executed instead of the first single-color display step. For example, the entirety of the display unit could be displayed in the second color in the second image display step and the second image erasing step in conjunction.

Accordingly, the method for driving an electrophoretic display device of the invention makes it possible to also compensate for the effects of a change in temperature while still striking a DC balance. For this reason, the long-term reliability can be ensured, and the display quality is enhanced. Also, because the partial drive format is still used, it is possible to shorten the refresh time for an image in comparison to a case where solely the full-screen drive format is used.

A third aspect can be the method for driving an electrophoretic display device, wherein in a case where the temperature detection unit detects the predetermined change in temperature after the causing the display unit to display the first image in the first color and before the causing the display unit to display the background of the first image, causing all the pixels of the display unit to be displayed in the second color by using the drive pulse signal, which has been adjusted on the basis of the temperature before the change, and the causing the display unit to display the predetermined image and the causing the display unit to complementarily display the predetermined image are executed after the first image erasing step.

According to the invention, the first single-color display step, the first image erasing step, and the second image erasing step are executed in a case where the temperature detection unit detects the predetermined change in temperature after the first image display step and before the first image erasing step. In other words, the first single-color display step in which the drive pulse signal that has been adjusted on the basis of the temperature before the change is used and the two steps in which the drive pulse signal that has been adjusted on the basis of the temperature after the change is used are added after the two steps in which the drive pulse signal that has been adjusted on the basis of the temperature before the change is used. These three added steps make it possible to remove the afterimage that can be produced by a change in temperature of the display unit and to compensate for the effects of the change in temperature, while still striking a DC balance.

Accordingly, the method for driving an electrophoretic display device of the invention makes it possible to compensate for the effects of a change in temperature while still striking a DC balance not only in a case where the temperature detection unit detects the predetermined change in temperature after the second image display step and before the second image erasing step, but also in a case where the temperature detection unit detects the predetermined change in temperature after the first image display step and before the first image erasing step.

A fourth aspect can be the method for driving an electrophoretic display device, wherein the causing the display unit to display the predetermined image and the causing the display unit to complementarily display the predetermined image use a single-color display as the predetermined display.

According to the invention, a single-color display is used as the predetermined display of the first afterimage erasing step and the second afterimage erasing step. A "single-color display" is, for example, a display in which the entirety of the display unit is set to the first color. At this time, because the entirety of the display unit will be set to the second color by the second afterimage erasing step, it is possible to execute the first image display step in succession. That is to say, the method for driving an electrophoretic display device of the invention obviates the need for a second single-color display step (described below), and makes it possible to compensate for the effects of a change in temperature while still striking a DC balance in fewer steps.

A fifth aspect can be the method for driving an electrophoretic display device, wherein the causing the display unit to display the predetermined image and the causing the display unit to complementarily display the predetermined image use a single-color display as the predetermined display, and causing all the pixels of the display unit to be displayed in the second color by using the drive pulse signal, which has been adjusted on the basis of the temperature after the change, is executed after the causing the display unit to complementarily display the predetermined image.

A sixth aspect can be the method for driving an electrophoretic display device, wherein the causing the display unit to display the predetermined image and the causing the display unit to complementarily display the predetermined image use a checkered pattern as the predetermined display.

According to these aspects, it is possible to use a display other than a single-color display, such as, for example, a checkered pattern, as the predetermined display of the first afterimage erasing step and the second afterimage erasing step. For this reason, it is possible to use any desired image that is highly effective in removing the afterimage that can be produced by a change in temperature of the display unit.

At this time, in some instances the partial drive format might be used in the first afterimage erasing step and the second afterimage erasing step in order to accelerate the refreshing time for the display images. In such a case, a DC balance can be struck when the second single-color display step for causing the entirety of the display unit to be displayed in the second color by using the drive pulse signal that has been adjusted on the basis of the temperature after the change is added after the second afterimage erasing step.

The method for driving an electrophoretic display device of these aspects makes it possible to remove the afterimage that can be produced by a change in temperature by using a display other than a single-color display, such as, for example, a checkered pattern, and therefore allows for further enhancement of the display quality.

A seventh aspect of the invention can be an electrophoretic display device provided with a control unit for executing the method for driving an electrophoretic display device.

According to the invention, the method of driving is realized by a control unit included in an electrophoretic display device. For this reason, the electrophoretic display device of the invention makes it possible to erase the afterimage that can be produced in a case where a change in temperature has occurred, while still striking a DC balance. For this reason, the long-term reliability is excellent and an afterimage is prevented from appearing, thereby offering a better appearance and improved display quality.

An eighth aspect of the invention can be an electronic apparatus including the electrophoretic display device.

A ninth aspect of the invention can be an electronic timepiece including the electrophoretic display device.

By using the electrophoretic display device, the electronic apparatus and electronic timepiece of these aspects of the invention make it possible to erase the afterimage that can be produced in a case where a change in temperature has occurred, while still striking a DC balance. For this reason, an electronic apparatus or electronic timepiece of excellent long-term reliability and favorable display quality can be realized.

BRIEF DESCRIPTION OF THE DRAWINGS

Referring now to the attached drawings which form a part of this original disclosure:

FIGS. 7A to 7E are drawings for describing the occurrence of an afterimage in the full-screen drive format;

FIGS. 8A to 8H are drawings illustrating an example of the display in a case where there is no temperature change in the first embodiment;

FIG. 9 is a drawing exemplifying a table representing the correspondence between the temperature and a drive pulse signal;

FIGS. 11A to 11H are drawings illustrating an example of the display in a case where there is a temperature change in the first embodiment;

FIGS. 13A to 13G are drawings illustrating another example of the display in a case where there is a temperature change in the first embodiment;

FIGS. 18A to 18H are drawings illustrating an example of the display in a case where there is a temperature change in the second embodiment;

DETAILED DESCRIPTION OF EXEMPLARY EMBODIMENTS

1. First Embodiment

The first embodiment of the invention shall now be described with reference to FIGS. 1 to 15. The electrophoretic display device of the first embodiment is understood to be able to display a variety of images, such as of letters, numbers, pictures, patterns, illustrations, and the like.

1.1. Configuration of the Electrophoretic Display Device

Figure 1:
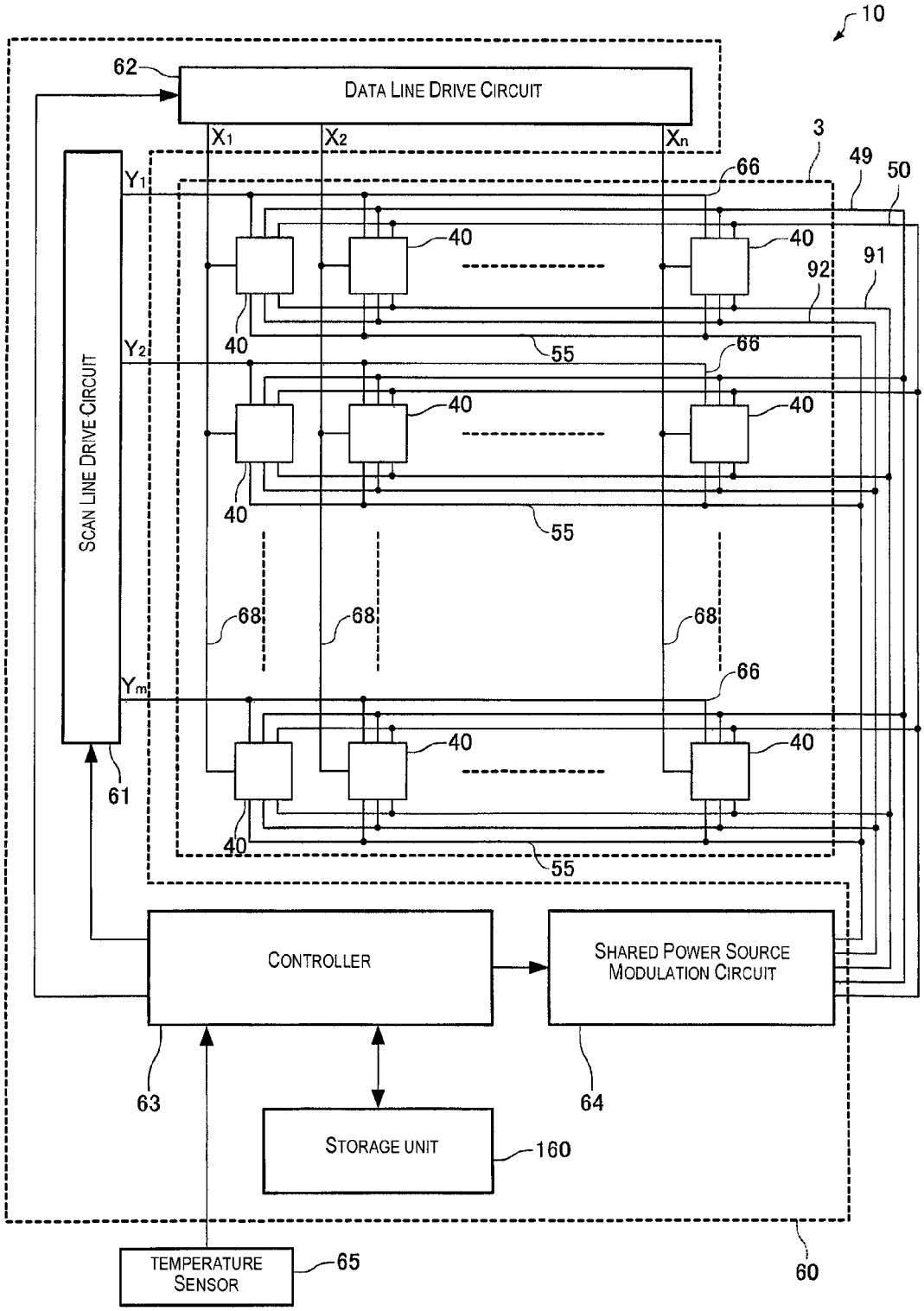
FIG. 1 is a block diagram of an electrophoretic display device in a first embodiment.

FIG. 1 is a drawing illustrating the configuration of an electrophoretic display device of an active matrix format in the present embodiment.

An electrophoretic display device 10 includes a display control circuit 60, a temperature sensor 65, and a display unit 3. The display control circuit 60 is a control unit for controlling the display unit 3, and includes a scan line drive circuit 61, a data line drive circuit 62, a controller 63, a shared power source modulation circuit 64, and a storage unit 160.

The scan line drive circuit 61, the data line drive circuit 62, the shared power source modulation circuit 64, and the storage unit 160 are each connected to the controller 63. The controller 63 has comprehensive control thereof, based on an input signal (not shown) such as, for example, a time signal.

The storage unit 160 can include, for example, a video random access memory (VRAM) as well as nonvolatile memory such as, for, example, a flash memory (not shown). The VRAM stores data regarding an image to be displayed on the display unit 3. The VRAM can be divided into a plurality of banks, each of which would then function as an individual VRAM. The nonvolatile memory stores data regarding elements constituting the data stored in the VRAM (for example, parts data and background data). The storage unit 160 additionally includes, for example, a static random access memory (SRAM) or a dynamic random access memory (DRAM), and is used by the controller 63 as a temporary storage region for data.

The temperature sensor 65 measures the temperature of the display unit 3 and outputs temperature data to the controller 63. The controller 63 compares the received temperature data and temperature data of the past, which is stored in the storage unit 160, to detect whether or not there has been a predetermined change in temperature (for example, a change of 3° or more). The temperature sensor 65, the controller 63, and the storage unit 160 constitute a temperature detection unit of the invention. The controller 63 controls the shared power source modulation circuit 64 and adjusts the drive pulse signal in a case where there has been the predetermined change in temperature.

A plurality of scan lines 66 which extend from the scan line drive circuit 61 and a plurality of data lines 68 which extend from the data line drive circuit 62 are formed on the display unit 3, and a plurality of pixels 40 are provided in correspondence to positions of intersection thereof.

The scan line drive circuit 61 is connected to each of the pixels 40 by m scan lines 66 (Y1, Y2, . . . , Ym). By sequentially selecting a scan line 66, from the first row to the m-th row, in conformity with the control of the controller 63, the scan line drive circuit 61 supplies a selection signal for defining the ON timing for a driving thin-film transistor (TFT) 48 (see FIG. 2) provided to the pixels 40.

The data line drive circuit 62 is connected to each of the pixels 40 by n data lines 68 (X1, X2, . . . , Xn). The data line drive circuit 62 supplies to the pixels 40 an image signal for defining image data regarding the one bit corresponding to each of the pixels 40, in conformity with the control of the controller 63. The present embodiment is understood to be such that a low-level image signal is supplied to the pixels 40 in a case where pixel data "0" is defined, and a high-level image signal is supplied to the pixels 40 in a case where pixel data "1" is defined.

Also provided to the display unit 3 are a low potential power source line 49 (Vss), a high potential power source line 50 (Vdd), a common electrode wiring 55 (Vcom), a first pulse signal line 91 (S1), and a second pulse signal line 92 (S2), all of which extend from the shared power source modulation circuit 64; each of the wirings is connected to the pixels 40. In conformity with the control of the controller 63, the shared power source modulation circuit 64 generates a variety of signals to be supplied to each of the wirings, and in turn either electrically connects or disconnects (causes a high impedance, or "Hi-Z", in) each of the wiring.

1.2. Circuitry Configuration of a Pixel Portion

Figure 2:
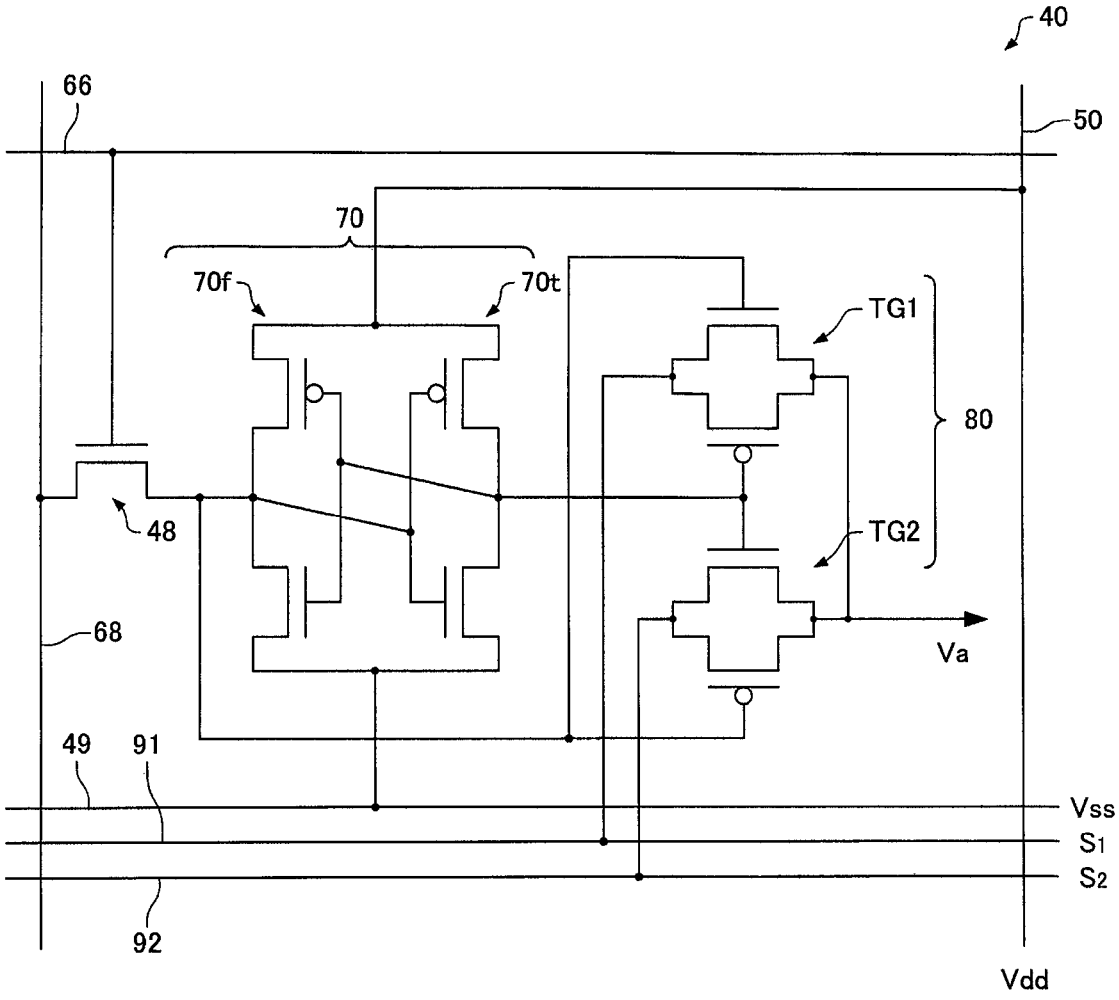
FIG. 2 is a drawing illustrating an example of a configuration of a pixel in the electrophoretic display device in the first embodiment.

FIG. 2 is a circuitry configuration diagram of the pixels 40 in FIG. 1. Like wirings to those in FIG. 1 have been assigned like reference numerals, and a description thereof has been omitted. A description has also been omitted for the common electrode wiring 55, which is shared among all pixels.

The driving TFT 48, a latch circuit 70, and a switch circuit 80 are provided to the pixels 40. The pixels 40 have a configuration of an SRAM format, in which an image signal is retained as an electric potential by the latch circuit 70.

The driving TFT 48 is a pixel switching element including an N-type metal-oxide-semiconductor (N-MOS) transistor. A gate terminal of the driving TFT 48 is connected to the scan line 66, a source terminal is connected to the data line 68, and a drain terminal is connected to a data input terminal of the latch circuit 70. The latch circuit 70 is provided with a transfer inverter 70*t* and a feedback inverter 70*f*. A power source voltage is supplied from the low potential power source line 49 (Vss) and the high potential power source line 50 (Vdd) to the transfer inverter 70*t* and the feedback inverter 70*f*.

The switch circuit 80 includes transmission gates TG1 and TG2, and outputs a signal to a pixel electrode 35 (see FIGS. 3B and 3C) in accordance with the level of the pixel data stored in the latch circuit 70. The term "Va" signifies the electric potential (signal) supplied to a pixel electrode of one pixel 40.

When pixel data "1" (a high-level image signal) is stored in the latch circuit 70 and the transmission gate TG1 is in an ON state, then the switch circuit 80 supplies the signal S1 as the Va. However, when pixel data "0" (a low-level image signal) is stored in the latch circuit 70 and the transmission gate TG2 is in an ON state, then the switch circuit 80 supplies the signal S2 as the Va. The circuitry configuration of such description makes it possible for the display control circuit 60 to control the electric potential (signal) supplied to the pixel electrodes of each of the pixels 40.

1.3. Display Format

The electrophoretic display device 10 of the present embodiment is understood to be an electrophoretic format of a two-particle microcapsule type. Assuming the dispersion solution to be colorless and translucent, and assuming the electrophoretic particles to be either white or black, at least two different colors can be displayed, with the two colors of white and black serving as basic colors. Herein, the electrophoretic display device 10 is described as being able to display black and white as basic colors. Thus, "inversion" is an expression indicating that pixels that were being displayed in black are displayed in white, or that pixels that were being displayed in white are displayed in black.

Figure 3A:
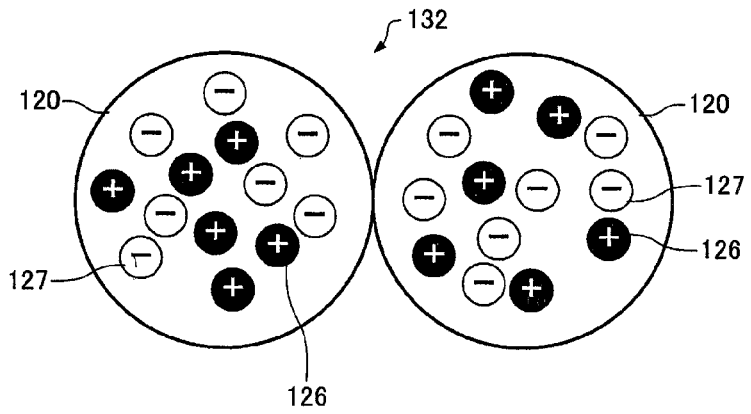
FIG. 3A is a drawing illustrating an example of a configuration of an electrophoretic element.

FIG. 3A is a drawing illustrating the configuration of an electrophoretic element 132 of the present embodiment. The electrophoretic element 132 is interposed between an element substrate 130 and a counter substrate 131 (see FIGS. 3B and 3C). The electrophoretic element 132 is configured by arraying a plurality of microcapsules 120. The microcapsules 120 enclose, for example, a colorless and translucent dispersion solution, a plurality of white electrophoretic particles (white particles 127), and a plurality of black electrophoretic particles (black particles 126). The present embodiment is understood as being such that for example, the white particles 127 are negatively charged and the black particles 126 are positively charged.

Figure 3B:
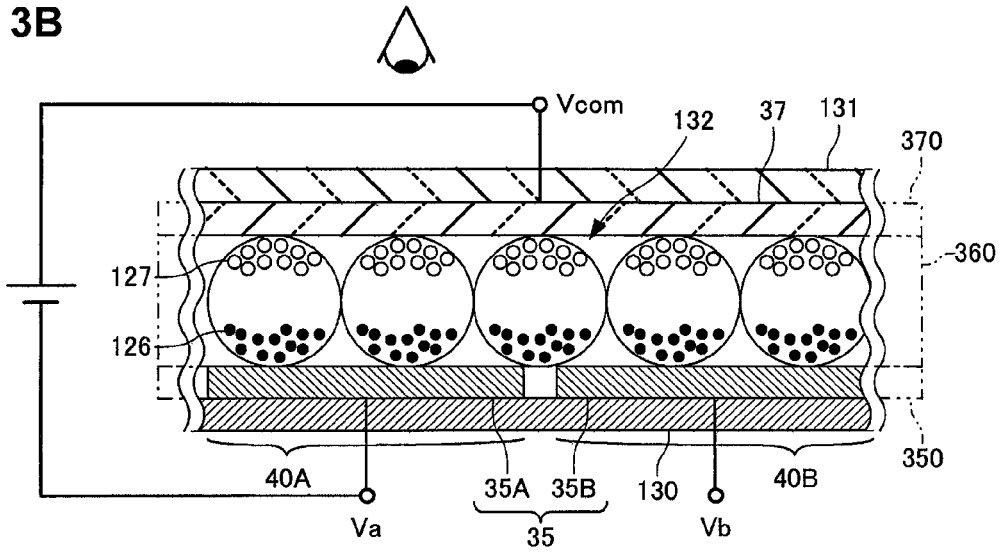
FIGS. 3B and 3C are explanatory views of the operation of the electrophoretic element.

FIG. 3B is a partial cross-sectional view of the display unit 3 of the electrophoretic display device 10. The element substrate 130 and the counter substrate 131 sandwich the electrophoretic element 132, obtained when the microcapsules 120 are arranged therein. The display unit 3 (see FIG. 1) includes a drive electrode layer 350 in which a plurality of pixel electrodes 35 are formed at an electrophoretic element (132)-side of the element substrate 130. FIG. 3B illustrates a pixel electrode 35A and a pixel electrode 35B as the pixel electrodes 35. The pixel electrodes 35 make it possible to supply an electric potential (for example, Va, Vb) to each of the pixels. Herein, the pixel to which the pixel electrode 35A belongs is a pixel 40A, and the pixel to which the pixel electrode 35B belongs is a pixel 40B. The pixel 40A and the pixel 40B are two pixels that correspond to the pixels 40 (see FIGS. 1 and 2).

The counter substrate 131, meanwhile, is a translucent substrate; images are displayed on the counter substrate (131)-side on the display unit 3. The display unit 3 includes a common electrode layer 370 in which a flat-shaped common electrode 37 is formed on the electrophoretic element (132)-side of the counter substrate 131. The common electrode 37 is a translucent electrode. The common electrode 37, unlike the pixel electrodes 35, is an electrode shared by all the pixels, to which an electric potential Vcom is supplied.

The electrophoretic element 132 is arranged in an electrophoretic display layer 360 provided between the common electrode layer 370 and the drive electrode layer 350, the electrophoretic display layer 360 serving as a display region. Each of the pixels can be made to display a desired display color, depending on the electric potential difference between the common electrode 37 and the pixel electrode (for example, 35A or 35B).

In FIG. 3B, the electric potential Vcom of the common electrode side is higher than the electric potential Va of the pixel electrode of the pixel 40A. At this time, the negatively charged white particles 127 are drawn toward the common electrode 37 and the positively charged black particles 126 are drawn toward the pixel electrode 35A, and thus the pixel 40A visually appears to be displaying white.

Figure 3C:
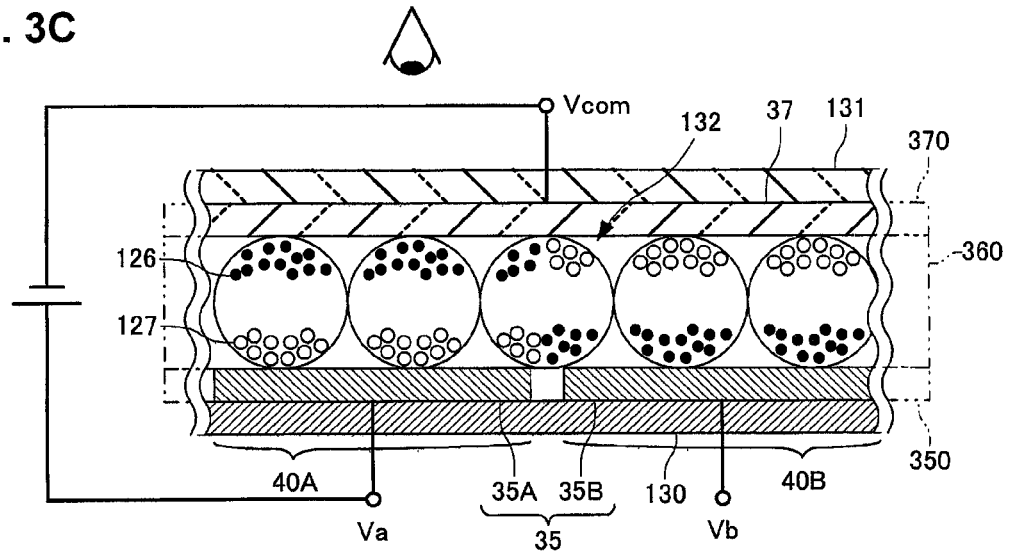

In FIG. 3B, the electric potential Vcom of the common electrode side is lower than the electric potential Va of the pixel electrode of the pixel 40A. At this time, the positively charged black particles 126 are drawn toward the common electrode 37 and the negatively charged white particles 126 are drawn toward the pixel electrode 35A, and thus the pixel 40A visually appears to be displaying black. The configuration in FIG. 3C is similar to that of FIG. 3B, and a description has been omitted. Va, Vb, and Vcom are described in FIGS. 3B and 3C as fixed potentials, but in actuality the potentials for Va, Vb, and Vcom change over time. The signals that give the electric potentials Va, Vb, Vcom are hereinafter referred to as pulse signals. A pulse signal to the common electrode, in particular, is referred to as a drive pulse signal.

FIG. 3B is understood herein as being followed by a change to the state in FIG. 3C. At this time, the pixel 40A displays black after having displayed white, and the direction of the applied electric field is changed to the polar opposite. For the pixel 40A, the applied electric field is symmetrical and strikes a DC balance. The pixel 40B, however, has displayed only white, and the applied electric field is not symmetrical, nor is a DC balance struck. Ensuring the long-term reliability of the electrophoretic display device necessitates carrying out an inverted display, such as with the example of the pixel 40A.

1.4. Drive Format

First, the drive formats for the pulse signals when a control unit (to which the display control unit 60 in FIG. 1 corresponds) carries out a control for the displaying of an image on the display unit shall now be described with reference to FIGS. 4A to 7E.

1.4.1. Partial Drive Format

Figure 4A:
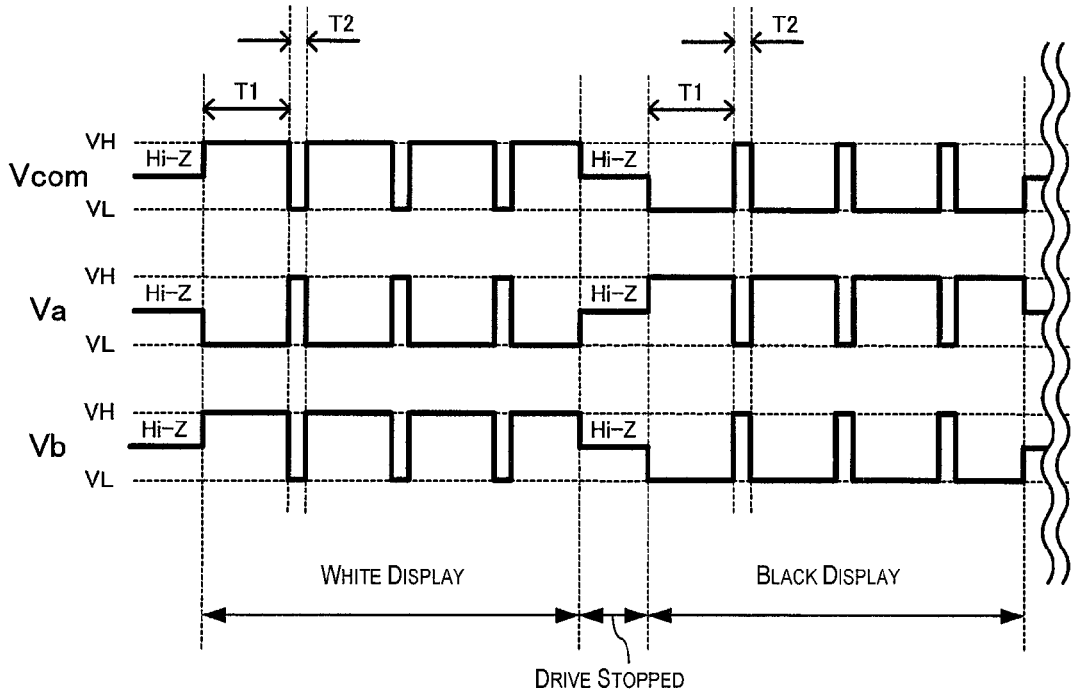
FIGS. 4A to 4B are drawings exemplifying the waveform diagram and reflectivity of the partial drive format.

FIG. 4A is a waveform diagram of the partial drive format. In an electrophoretic display device, in order to increase the response speed, in some instances rather than render the entirety of the display unit, a part that is intended to be written over is rendered. The partial drive format makes it possible to render a part that is intended to be rewritten. The Va, Vb, and Vcom in FIG. 4A are identical to those in FIGS. 3B to 3C; Va, Vb, and Vcom can assume a high-level (VH), low-level (VL), or high-impedance state (Hi-Z).

The Vcom in FIG. 4A illustrates an example of a drive pulse signal to the common electrode. The Vcom herein has a pulse by which a first electric potential is applied to the common electrode at a given pulse width T1 (hereinafter, referred to as simply T1), followed by a pulse by which a second electric potential is applied to the common electrode at a shorter pulse width T2 (hereinafter, referred to as simply T2), and is repeated. Immediately before the driving is stopped, however, the first electric potential is exceptionally applied to the common electrode to end the driving, as in FIG.

4A. The inverse potential drive pulse having a shorter pulse width makes it possible to further curtail the drive time in partial rewriting. Herein, in a case where white is being displayed, the first potential is VH (the second potential is VL), and in a case where black is being displayed, the first potential is VL (the second potential is VH). Also, for example, T2 can be shorter than T1 by about 1% to 15%.

In this example, the pulse signal giving the electric potential Va to be applied to the pixel electrode of the pixel 40A is an inverse signal of the drive pulse signal. Also, the pulse signal giving the electric potential Vb to be applied to the pixel electrode of the pixel 40B is the same signal as the drive pulse signal (a normal signal). The pixel 40A and the pixel 40B are, for example, the two pixels illustrated in FIG. 3B. The pixel 40A is rewritten from black to white in the time represented as "white display" in FIG. 4A, and is rewritten from white to black in the time represented as "black display". The pixel 40B, however, continues the black display without being rewritten, because no electric field is produced between the common electrode and the pixel electrode.

Figure 4B:
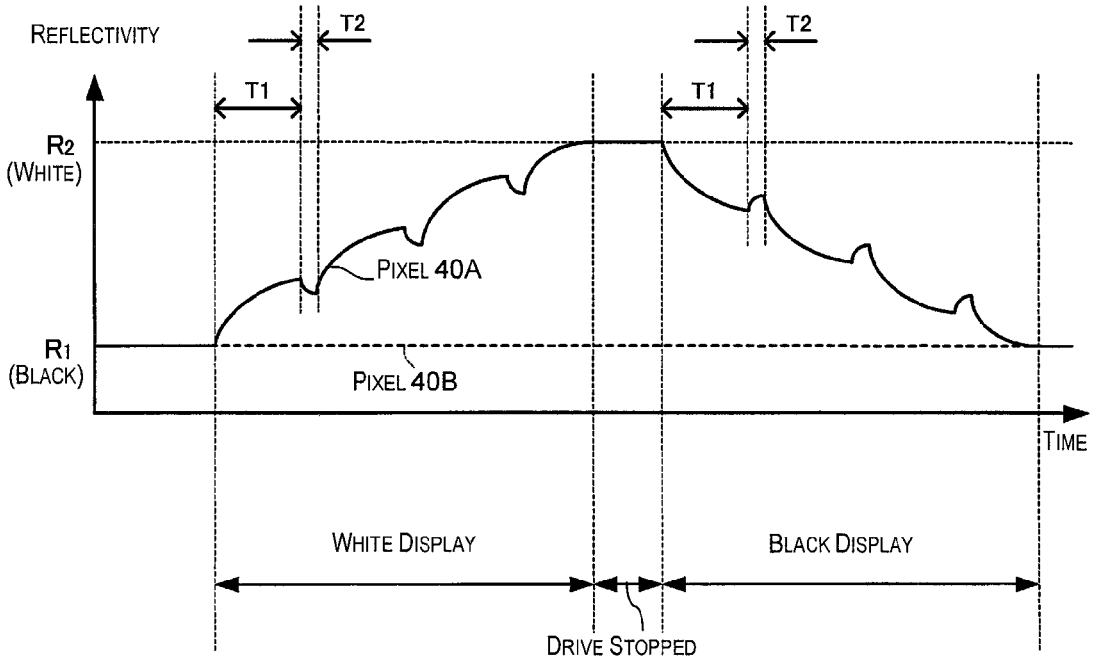

FIG. 4B is a drawing illustrating the changes in the colors (reflectivity) of the pixel 40A and the pixel 40B according to the example in FIG. 4A. The pixel 40A shall be described first. The pixel 40A is understood to have initially displayed black. An interval corresponding to the T1 for "white display" approaches a white display, because the electric potential of the pixel electrode is VL and the electric potential of the common electrode is VH. An interval corresponding to the T2 for the "white display", however, approaches the black display, because the electric potential of the pixel electrode is VH and the electric potential of the common electrode is VL. However, because T1>T2, the pixel 40A is displayed in white at the very end of the time for the "white display". The pixel 40A is displayed in black at the very end of the time for the "black display" during which time the polarity of Vcom is inverse.

The pixel 40B, however, continues displaying black from the beginning, without experiencing any electric potential difference, because the same signal as with Vcom is supplied at all times to the pixel electrode. Thus, in the partial drive format, it is possible to drive solely those pixels which should be changed, and possible to increase the response speed in rewriting the pixels. In particular, the use of the inverse potential drive pulse having a shorter pulse width makes it possible to curtail the drive time in partial rewriting.

Being suitable for cases where a part that is intended to be rewritten is rendered, the format for driving a pulse signal of such description is accordingly termed a partial drive format. However, the partial drive format in no way limits the intention of rewriting to solely some of the pixels of the display unit. For this reason, it is possible to render all of the pixels of the display unit in the partial drive format.

1.4.2. Problems in the Partial Drive Format

Figure 5A:
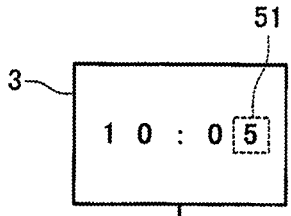
FIGS. 5A to 5D are drawings for describing a local drop in the contrast ratio.
Figure 5B:
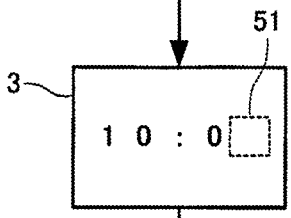
Figure 5C:
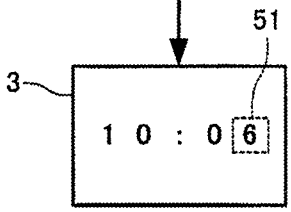

FIGS. 5A to 5D are drawings for describing a local drop in the contrast ratio in a case where a partial region has been rewritten in the partial drive format. In FIGS. 5A to 5C, a time ("10:05" or "10:06") has been displayed on the display unit 3, and a region 51 which includes one of the minute digits has been rewritten in the partial drive format.

In FIG. 5A, the time 10:05 is being displayed. Then, when the time changes to 10:06, the display of the "5" in the minute digit in the region 51 is inverted (displayed in white) and erased, as in FIG. 5B. Next, as in FIG. 5C, a black "6" having a white background is displayed normally. At this time, a DC balance is struck between FIGS. 5A and 5B, and moreover less time is needed to refresh the display, because the refresh is carried out in the range of the region 51, which is only a part of the display unit 3. Refreshing the time display by the partial drive format as in FIGS. 5A to 5C makes it possible to strike a DC balance and ensure long-term reliability, and to realize an electrophoretic display device enabling rapidly refreshed display.

Figure 5D:
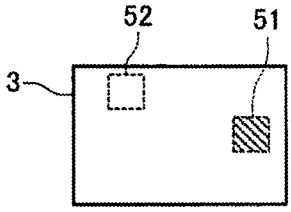

However, when the display refreshing of such description is continued for a long time, in some instances a local drop in the contrast ratio is produced. FIG. 5D serves to represent this situation. In FIG. 5D, though the full screen of the display unit 3 is displaying white, a drop in the contrast ratio is produced in the region 51. For this reason, the white in the region 51 is different from that of other regions (for example, a region 52).

Herein, the local drop in the contrast ratio is produced by the long-term repeated application of an electric field to the region 51, which is a part of the display unit 3. In other words, the number of times the signal used to apply the voltage is driven for the region 51 and the number of times the signal is driven for regions other than the region 51 (for example, the region 52) begins to vary considerably over time. A local drop in the contrast ratio such as in FIG. 5D will cause a drop in the display quality of the display unit 3.

1.4.3. Full-Screen Drive Format

Figure 6A:
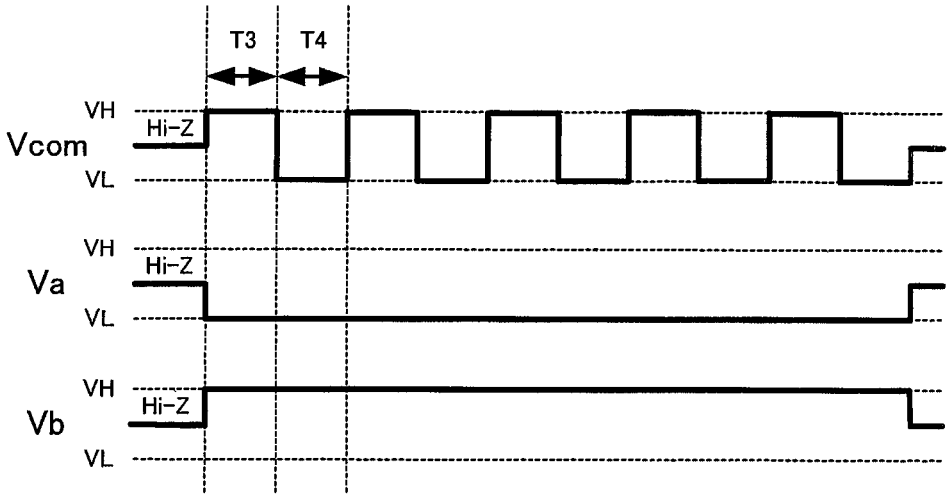
FIGS. 6A to 6B are examples of the waveform diagram and reflectivity of the full-screen drive format.

FIG. 6A is a waveform diagram of the full-screen drive format. In an electrophoretic display device, an image can also be displayed by the full-screen drive format, in which the entirety of the display unit is rendered. At this time, there is no long-term repeated application of an electric field to only a region that is a part of the display unit, and thus unlike the partial drive format, no local drop in the contrast ratio will be produced. The Va, Vb, and Vcom, and the VH and VL in FIG. 6A are the same as those in FIGS. 3A to 4B, and a description thereof has been omitted.

FIG. 6A illustrates the waveform diagram of a case where the pixel 40A is changed from black to white and the pixel 40B is changed from white to black by the full-screen drive format. In FIG. 6A, while the display colors are being changed, Va remains low-level (VL), and Vb remains high-level (VH). Vcom, then, repeats both VL and VH for an equal length of time. In other words, a pulse width T3 (hereinafter, referred to as simply T3) and a pulse width T4 (hereinafter, referred to as simply T4) in FIG. 6A are equal to each other.

Figure 6B:
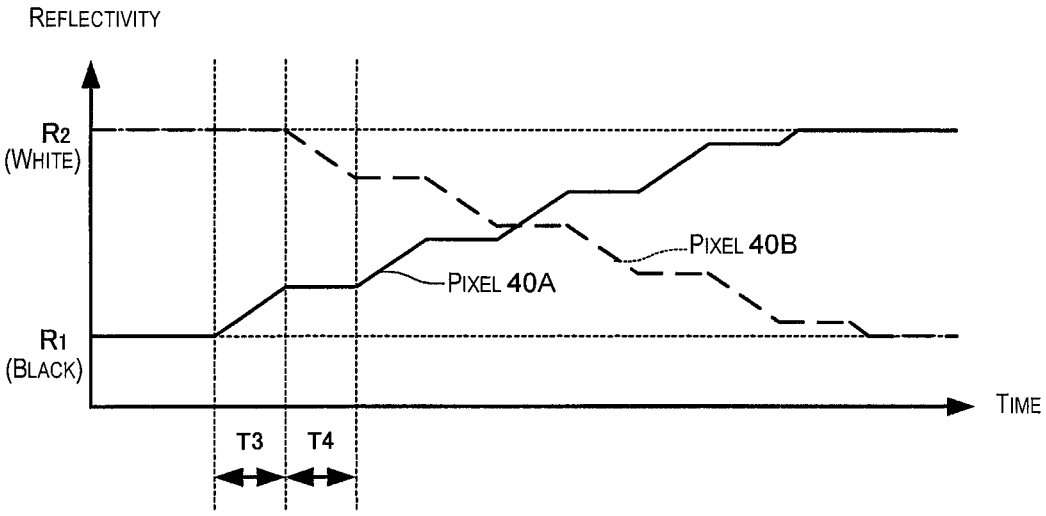

FIG. 6B is a drawing illustrating the changes in color (reflectivity) of the pixels 40A and 40B according to the example in FIG. 6A. The pixel 40A is displayed in black at first. An interval corresponding to the T3 in FIG. 6B approaches the white display, because the electric potential of the pixel electrode is VL and the electric potential of the common electrode is VH. An interval corresponding to T4 in FIG. 6B maintains the coloring, because no electric potential difference is produced between the pixel electrode and the common electrode. Finally, the pixel 40A changes from black to white.

The pixel 40B, in turn, is displayed in white at first. An interval corresponding to T3 in FIG. 6B maintains the coloring, because, no electric potential difference is produced between the pixel electrode and the common electrode. An interval corresponding to the T4 in FIG. 6B approaches the black display, because the electric potential of the pixel electrode is VH and the electric potential of the common electrode is VL. Finally, the pixel 40B changes from white to black.

Herein, in the full-screen drive format, an electric potential of either VL or VH is applied to the pixel electrodes of all the pixels of the display unit 3. Because there is no long-term repeated application of an electric field to solely a region that is a part of the display unit, no local drop in the contrast ratio will be produced.

In the full-screen drive format, all of the pixels of the display unit are subject to being rendered, and it is not possible to rewrite only some of the pixels of the display unit. In keeping with the name therefor, all of the pixels of the display unit will be rendered.

1.4.4. Problems in the Full-Screen Drive Format

FIGS. 7A to 7E are drawings for describing the occurrence of an afterimage in the full-screen drive format. Firstly, as in FIG. 7A, the display unit 3 is split into four regions (upper left, upper right, lower left, and lower right), where the upper left region and the upper right region in particular are referred to as a region X and a region Y, respectively. Herein, as in FIG. 3B, the neighboring pixel 40A and pixel 40B are present, and are understood to be included in the region X and the region Y, respectively.

FIGS. 7B to 7D represent the manner in which an image is refreshed in the full-screen drive format. Firstly, in FIG. 7B, the left half of the display unit 3, which includes the region X, is displayed in black, while the right half, which includes the region Y, is displayed in white. FIG. 7B is understood to be an original image prior to refreshing.

The display image is then refreshed, where the refreshed image is understood to be an image in which the upper half, which includes the region X and the region Y, is black. At this time, in order to strike a DC balance, the display is first inversed, as in FIG. 7C. In other words, the region X and the region Y are displayed in white, as in FIG. 7C.

Thereafter, as in FIG. 7D, an image in which the upper half, which includes the region X and the region Y, is black is displayed, but the black of the region Y and the black of the region X are different. In the example in FIG. 7D, the black of the region Y is of a higher reflectivity than that of the black of the region X. The difference in reflectivity of such description in some instances produces an afterimage in a case where the image has been refreshed by the full-screen drive format.

FIG. 7E is a comparison of the changes in reflectivity of the pixel 40A, which is included in the region X, and the pixel 40B, which is included in the region Y. An interval TB, an interval TC, and an interval TD in FIG. 7E correspond to FIG. 7B, FIG. 7C, and FIG. 7D, respectively. Firstly, the pixel 40A is black at first (interval TB), and thereafter is changed to white, and then black (intervals TC and TD). This change is expressed as "(black, white, black)". Then, the changes of the pixel 40B can be represented by "(white, white, black)".

Herein, in a case where there is a sufficiently long time for driving the pulse signals in the full-screen drive format (a case where TD is extended by an amount commensurate with TEX), then both the pixel 40A and the pixel 40B converge on the reflectivity RC (=R1) of FIG. 7E. For this reason, no difference in reflectivity is produced, nor will an afterimage be generated. However, in actual practice, an extension lasting as long as TEX does not happen, in order to reduce the refresh time for the display image. Thus, the pixel 40A, which changes to be (black, white, black), will be at a reflectivity RA, while the pixel 40B, which changes to be (white, white, black), will be at a reflectivity RB, and therefore a difference in reflectivity is produced and an afterimage is generated.

Accordingly, though no local drop in the contrast ratio is produced, a case where the full-screen drive format is carried out rather than the partial drive format still has another problem in the concern that an afterimage will be generated. For this reason, there has been a need for a method for driving an electrophoretic display device whereby neither the problem of a local drop in the contrast ratio nor the problem of an afterimage will be generated.

1.5. Display Example of the Present Embodiment

A display example in the present embodiment shall now be described, with reference to FIGS. 8A to 14. Referring first to FIGS. 8A to 10, a general method for driving an electrophoretic display device in a case where there is no change temperature shall be illustrated, and this method of driving shall be shown not to generate the problem of a drop in the contrast ratio, nor the problem of an afterimage that is produced when the image refresh time is curtailed in the full-screen drive format. Referring next to FIGS. 11A to 14, it shall be illustrated that a DC balance can be struck even in a case where a change in temperature takes place, and that a suitable drive pulse signal can be selected to eliminate the afterimage that would be produced by the change in temperature.

1.5.1. Case where there is No Change in Temperature

FIGS. 8A to 8H represent a display example of the present embodiment, in a case where there is no change in temperature. Each of the left-side drawings in FIGS. 8A to 8H represent a display image of the display unit 3, and the right-side drawings represent drive pixels 13, where dark grey is used to represent pixels that are driven in order to carry out the display of the display unit 3. Below the drive pixels 13 are illustrated a distinction between the full-screen drive format and the partial drive format and a distinction between whether the pixels represented in dark grey among the drive pixels 13 are displayed in black or are displayed in white.

The names of the steps in FIGS. 8A to 8H correspond to the names of steps in a flow chart that shall be described below. The numbers enclosed in parentheses affixed after the steps represent the sequence of execution, in order to distinguish between steps of the same name.

Herein, a control unit of the electrophoretic display device of the present embodiment carries out a control in which the image of the display unit is refreshed from an original image that has already been displayed to a subsequent new image. In other words, a control for erasing the original image and display the new image is executed.

The control for erasing the original image and the control for displaying the new image are executed in a predetermined sequence. Each of the stages for executing the control relating to the refreshing of the image is termed a "step". For example, a stage at which the control unit executes a first image display control is expressed as a first image display step. The execution of a corresponding control by the control unit in each of the steps is expressed hereinbelow simply as "a [ . . . ] step is executed" or "[ . . . ] executes a [ . . . ] step". For example, the execution of the first image display control by the control unit in the first image display step is expressed simply as "the first image display step is executed" or "[ . . . ] executes the first image display step".

FIG. 8A represents the display image of the display unit 3 when the first image display step (1) is executed, as well as the drive pixels 13 therefor. In the first image display step (1), a time display "10:05" (corresponding to a first image) is displayed in black (corresponding to a first color) on the display unit 3 by the partial drive format. Prior to the execution of the first image display step (1), the display unit 3 is understood to have been in a state where the entire screen was white.

FIG. 8B represents the display image of the display unit 3 when a first image erasing step (1) is executed, as well as the drive pixels 13 therefor. In the first image erasing step (1), portions other than the time display "10:05" (corresponding to a background of the first image) are displayed in black (corresponding to the first color) on the display unit 3 by the partial drive format. At this time, the display unit 3 will be in a state where the entire screen is black.

FIG. 8C represents the display image of the display unit 3 when a second image display step (1) is executed, as well as the drive pixels 13 therefor. In the second image display step (1), portions other than a time display "10:06" (corresponding to a background of a second image) are displayed in white (corresponding to a second color) on the display unit 3 in the partial drive format. At this time, the time display "10:06" will be displayed on the display unit 3 in black.

FIG. 8D represents the display image of the display unit 3 when a second image erasing step (1) is executed, as well as the drive pixels 13 therefor. In the second image erasing step (1), the time display "10:06" (corresponding to the second image) are displayed in white (corresponding to the second color) on the display unit 3 in the partial drive format. At this time, the display unit 3 will be in a state where the entire screen is white.

FIG. 8E represents the display image of the display unit 3 when, after the second image erasing step (1), the first image display step (2) is again executed, as well as the drive pixels 13 therefor. In the first image display step (2), a time display "10:07" (corresponding to the first image) is displayed in black (corresponding to the first color) on the display unit 3 by the partial drive format.

Hereinafter, FIGS. 8F to 8H correspond to cases where the first image is a time display "10:07" and the second image is a time display "10:08" in FIGS. 8B and 8D, respectively, and thus a more detailed description thereof has been omitted. In the examples in FIGS. 8A to 8H, however, the time display is changed in one-minute intervals, and each of the steps is also executed in correspondence with the respective change. For example, one minute after the time display "10:05" has been displayed (FIG. 8A), the display unit 3 will enter a state where the entire screen is black (FIG. 8B), following which the time display "10:06" is displayed (FIG. 8C).

These steps (the first image display step, the first image erasing step, the second image display step, and the second image erasing step) are all in the partial drive format, and the afterimage that is produced when the time for processing to refresh the display image is curtailed in the full-screen drive format will not be generated.

Herein, when the drive pixels 13 of the first image display step (1) in FIG. 8A and of the first image erasing step (1) in FIG. 8B are combined, all of the pixels of the entirety of the display unit are changed to black. When the drive pixels of the second image display step (1) in FIG. 8C and of the second image erasing step (1) in FIG. 8D are combined, however, all of the pixels of the entirety of the display unit are changed to white.

There is no change in temperature during the execution of these four steps. Herein, that there is no change in temperature signifies that there is no change in temperature not less than a predetermined temperature. The "predetermined temperature" can be established in a fixed manner, such as, for example, 3°, or can be established on the basis of a table in which temperatures and drive pulse signals are associated together, such as in the present embodiment.

FIG. 9 is a drawing exemplifying a table representing the correspondence between the temperature and a drive pulse signal. In the present embodiment, there is understood to be a change in temperature not less than the predetermined temperature in a case where a difference of two stages is produced in the table in FIG. 9. For example, a change in temperature from 11° C. to 15° C., is handled as though there were no change in temperature, because a difference of solely one stage is produced in the table in FIG. 9. A difference of two stages is understood not to have been produced then in the table in FIG. 9.

At this time, for example, where the temperature of the display unit 3 is TP1, then a drive pulse signal that has been adjusted for the temperature TP1 (hereinafter referred to as simply "TP1") is used in all four steps, as in FIG. 10. For this reason, a DC balance is struck in the four steps in FIGS. 8A to 8D. The same is also true of the second iteration of the steps in FIGS. 8E to 8H, and a DC balance will be struck in the four steps. A "drive pulse signal that has been adjusted for the temperature TP1" means a signal obtained when a pulse for which T1 is 90 [ms], T2 is 10 [ms], and the amplitude is 15 V is repeated six times, referring again to FIG. 9 where TP1 is, for example, 11° C. Herein, T1 and T2 are the pulse widths T1, T2 that were described using FIGS. 4A to 4B. In the example in FIG. 9, the amplitude and T2 are constant, but the amplitude and T2 can also be adjusted.

Figure 10:
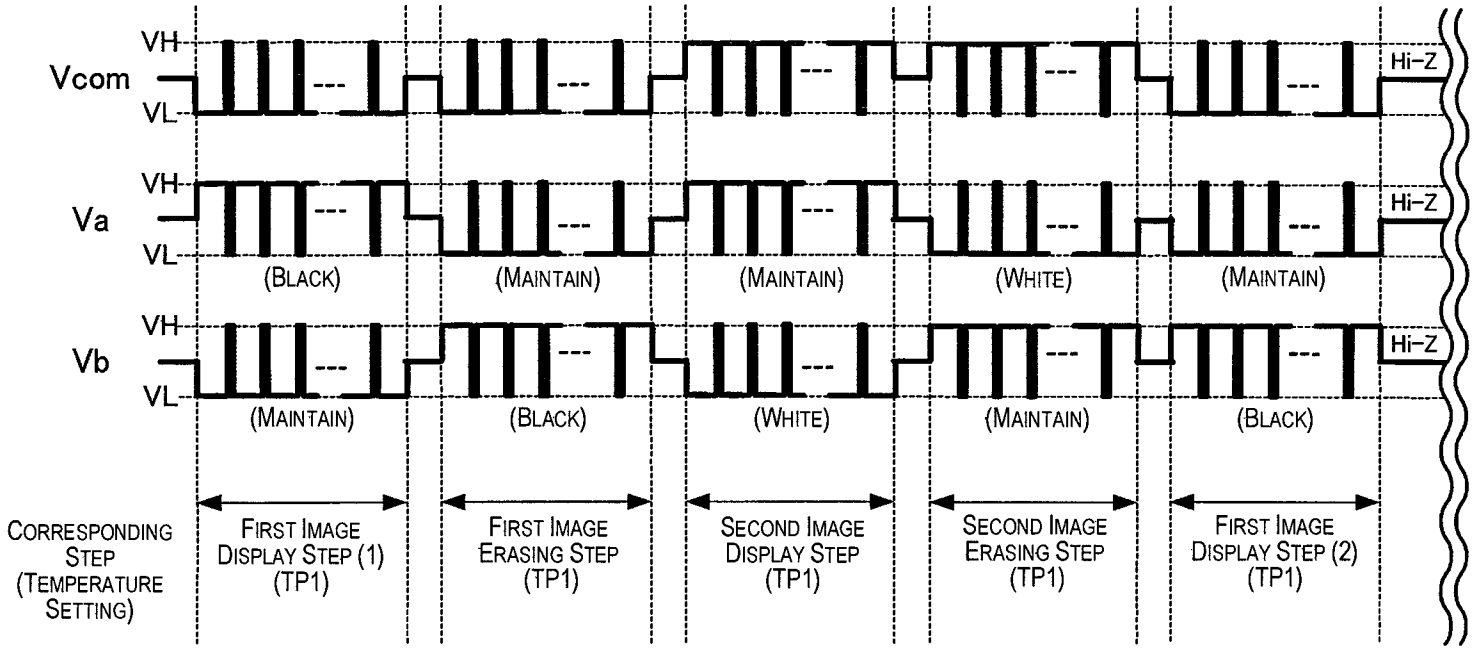
FIG. 10 is a drawing exemplifying changes in the voltage applied to an electrode in correspondence with the steps in FIGS. 8A to 8E.

The description relates now to FIG. 10. FIG. 10 is a waveform diagram representing the drive pulse signals corresponding to the steps in FIGS. 8A to 8E, or the like. Like element between FIGS. 4A to 4B and FIGS. 6A to 6B have been assigned like reference numerals, and a description thereof has been omitted. FIG. 10 illustrates the drive pulse signal (Vcom) to the common electrode, the different pulse signals (Va, Vb) to the two pixel electrodes, and the corresponding steps, which are indicative of the specific step among the steps in FIGS. 8A to 8E to which there is correspondence. The partial drive format is used in all of the steps illustrated in FIG. 10, and the different pulse signals (Va, Vb) to the two pixel electrodes are either normal or inverse versions of the drive pulse signal (Vcom).

The notations enclosed by parentheses affixed after the corresponding steps in FIG. 10 are indicative of the temperature that is used in establishing the waveform of the drive pulse signal in the corresponding step. Herein, there is no change in temperature, and drive pulse signals that have been adjusted on the basis of the temperature TP1 are used in all of the steps. Also, FIG. 10 omits a representation of the second iteration of the first image erasing step and thereinafter.

To summarize the description above, in a case where there is no change in temperature, the method for driving an electrophoretic display device in the present embodiment does not produce the problem of a local drop in the contrast ratio, which can be produced in the partial drive format. In other words, all of the pixels of the entirety of the display unit are changed either to black (the first image display step and the first image erasing step), or to white (the second image display step and the second image erasing step), and thus the electric field is applied uniformly to the entirety of the display unit.

The local drop in the contrast ratio is produced by the long-term repeated application of an electric field to a region that is solely a part (hereinafter, a "specific region") of the display unit. In other words, the number of times the signal used to apply the voltage is driven for the specific region and the number of times the signal is driven for regions other than the specific region begins to vary considerably over time. In the method for driving an electrophoretic display device in the invention, no such specific region will be produced, and thus no local drop in the contrast ratio will be generated.

Accordingly, in a case where there is understood not to be a change in temperature, the method for driving an electrophoretic display device in the present embodiment produces neither a local drop in the contrast ratio nor an afterimage, while still striking a DC balance, and thus the long-term reliability can be ensured and the display quality is enhanced.

1.5.2. Change in Temperature in the Second Image Display Step to the Second Image Erasing Step FIGS. 11A to 11H represent a display example of the present embodiment in a case where there is a change in temperature after the second image display step and before the second image erasing step. Like elements to those in FIGS. 1 to 10 have been assigned like reference numerals, and a description thereof has been omitted. The table representing the associations between the temperatures and the drive pulse signals is as per FIG. 9.

In a case where there is a change in temperature, when a drive pulse signal that has been adjusted on the basis of the temperature before the change is used to either display or erase an image, then the charged particles are subjected to either too much or too little energy for moving same through the dispersion solution (herein, the total reached by multiplying the applied electric field by the application time is referred to as the energy), and thus in some instances the display will not be the desired display of either black or white, and an afterimage will be produced.

By way of example, the temperature is understood to have changed from TP1 to TP2 during the about one minute of time display (in this example, "10:06") after the second image display step of FIG. 11C was executed. At this time, when the drive pulse signal that has been adjusted to TP1 is used to execute the second image erasing step, an afterimage is produced as in FIG. 11D.

The description again referring to FIG. 9, in a case where, for example, the temperature has changed from 11° C. (corresponding to TP1) to 18° C. (corresponding to TP2), then a difference of two stages is produced in the table, and the number of times the pulse is repeated changes considerably, from six times to four times. For this reason, an afterimage is produced, as in FIG. 11D. To erase this afterimage, in the present embodiment, a drive pulse signal that has been adjusted to the temperature after the change (TP2) is used to execute a first afterimage erasing step and a second afterimage erasing step in a case where a predetermined change in temperature producing a difference of two stages in the table has been detected.

FIGS. 11E and 11F illustrate a display example of a case where the first afterimage erasing step and the second afterimage erasing step, respectively, are executed. In this example, the first afterimage erasing step is the partial drive format, in which the drive pulse signal having been adjusted to TP2 is used, and a single-color display of black (corresponding to the first color) is executed as a predetermined image of the invention. The second afterimage erasing step is the partial drive format, in which the drive pulse signal having been adjusted to TP2 is used, and the single-color display of black is complementarily displayed. More specifically, a single-color display of white (corresponding to the second color) is executed. That is to say, the complementary display of the second afterimage erasing step of the present embodiment is equivalent to an inverse display.

At this time, in the first afterimage erasing step and the second afterimage erasing step, the afterimage can be erased because the drive pulse signal that has been adjusted to TP2, which is the temperature after the change, is used. Also, the use of the single-color display of black (corresponding to the first color) as the predetermined image causes the complementary display of the second afterimage erasing step to be an inverse display of the predetermined image, and strikes a DC balance between the two steps.

Figure 12:
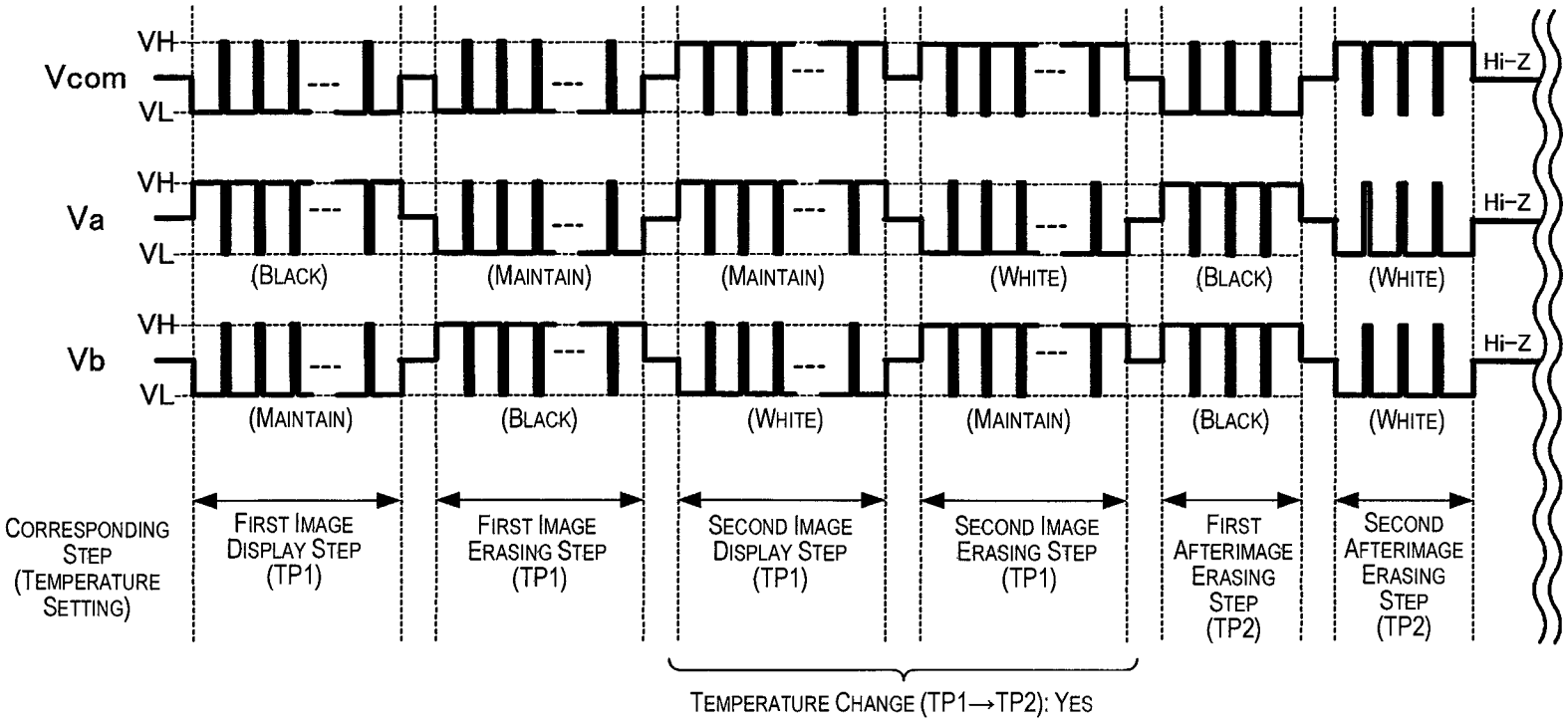
FIG. 12 is a drawing exemplifying changes in the voltage applied to an electrode in correspondence with the steps in FIGS. 11A to 11F.

FIG. 12 represents the drive pulse signals corresponding to the steps in FIGS. 11A to 11F, and so forth. In the first of the four steps (the first image display step, the first image erasing step, the second image display step, and the second image erasing step), the drive pulse signal adjusted to TP1 is used. However, in the first afterimage erasing step and the second afterimage erasing step, which are executed as additions, the drive pulse signal adjusted to TP2 is used. Identically to the case in FIG. 10, a DC balance has been struck in the first four steps; a DC balance is also struck in the first afterimage erasing step and the second afterimage erasing step, in which the mutually inverse single-color displays are carried out, as described earlier. For this reason, a DC balance is struck in the six steps of FIGS. 11A to 11F.

As per the foregoing, the method for driving an electrophoretic display device of the present embodiment makes it possible, even in a case where there is a change in temperature after the second image display step and before the second image erasing step, to also compensate for the effects of a change in temperature (more specifically, an afterimage such as that in FIG. 11D) while still striking a DC balance. For this reason, the long-term reliability can be ensured, and the display quality is enhanced. Also, because the partial drive format is still used, it is possible to shorten the refresh time for an image in comparison to a case where solely the full-screen drive format is used. FIGS. 11A to 11B are identical to FIGS. 8A to 8B, and FIGS. 11G to 11H are identical to FIGS. 8E to 8F, and thus a description thereof has been omitted.

1.5.3. Change in Temperature in the First Image Display Step to the First Image Erasing Step FIGS. 13A to 13G represent a display example of the present embodiment in a case where there is a change in temperature after the first image display step and before the first image erasing step. Like elements to those in FIGS. 1 to 12 have been assigned like reference numerals, and a description thereof has been omitted. The table representing the associations between the temperatures and the drive pulse signals is as per FIG. 9.

By way of example, the temperature is understood to have changed from TP3 to TP4 during the about one minute of time display (in this example, "10:05") after the first image display step of FIG. 13A was executed. At this time, when the drive pulse signal that has been adjusted to TP3 is used to execute the first image erasing step, an afterimage is produced as in FIG. 13B. TP3 and TP4 are temperatures of no relation to the TP1 and TP2 mentioned earlier, but the following description shall use the same temperatures as those of TP1 and TP2 by way of example.

The description again referring to FIG. 9, in a case where, for example, the temperature has changed from 11° C. (corresponding to TP3) to 18° C. (corresponding to TP4), then a difference of two stages is produced in the table, and an afterimage is produced, as in FIG. 13B. To erase this afterimage, in the present embodiment, a drive pulse signal that has been adjusted to the temperature after the change (TP4) is used to execute the first afterimage erasing step of FIG. 13D and the second afterimage erasing step of FIG. 13E in a case where a predetermined change in temperature producing a difference of two stages in the table has been detected.

At this time, the afterimage can be erased, because in the first afterimage erasing step and the second afterimage erasing step, the drive pulse signal that has been adjusted to TP4, which is the temperature at the change, is used. Also, the use of the single-color display of black (corresponding to the first color) as the predetermined image causes the complementary display of the second afterimage erasing step to be an inverse display of the predetermined image, and strikes a DC balance between the two steps.

However, unlike the case where there is a change in temperature after the second image display step and before the second image erasing step, the steps in which the drive pulse signal that has been adjusted to TP3, which is the temperature before the change, are solely the first image display step of FIG. 13A and the first image erasing step of FIG. 13B. For this reason, merely adding the first afterimage erasing step and the second afterimage erasing step does not make it possible to strike DC balance. Therefore, a first single-color display step of FIG. 13C, in which all of the pixels of the display unit 3 are displayed in white (the second color), is executed in the partial drive format, in which the drive pulse signal having been adjusted to TP3 is used. So doing allows the first image display step, the first image erasing step, and the first single-color display step to strike a DC balance.

Figure 14:
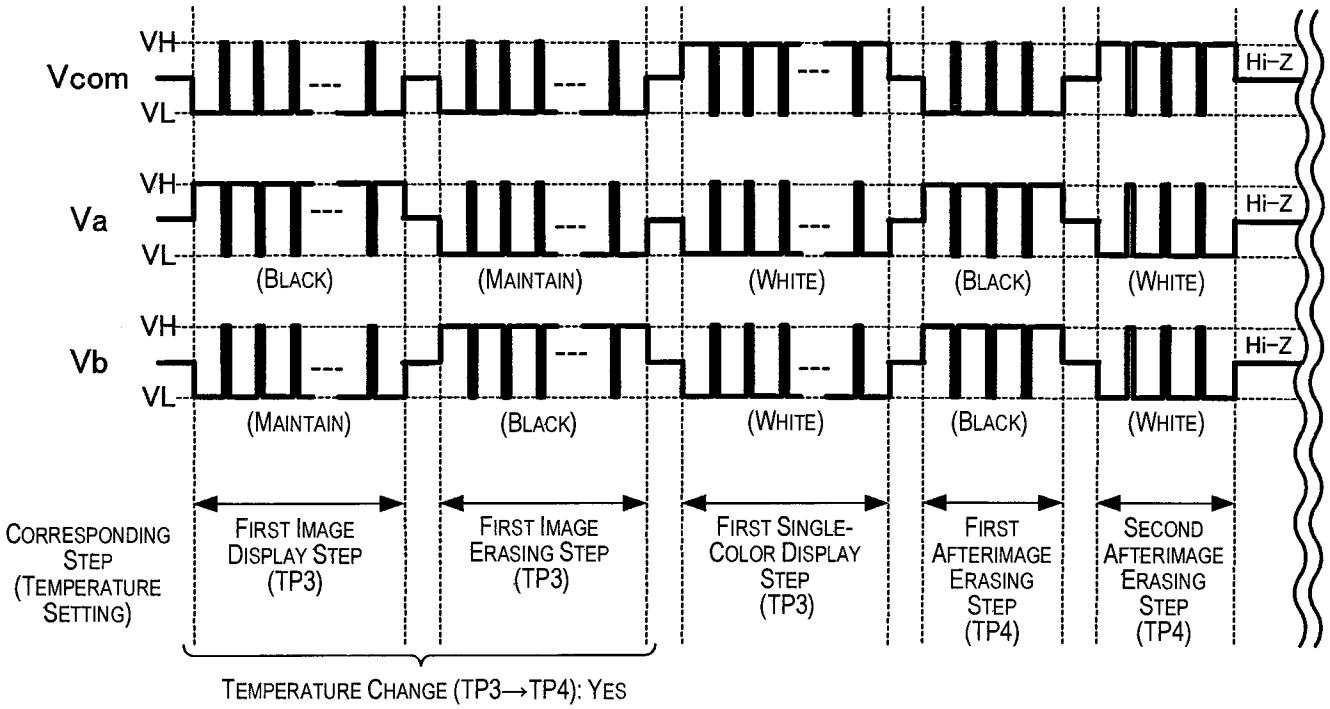
FIG. 14 is a drawing exemplifying changes in the voltage applied to an electrode in correspondence with the steps in FIGS. 13A to 13E.

FIG. 14 represents the drive pulse signals corresponding to the steps in FIGS. 13A to 13E, and so forth. The drive pulse signal having been adjusted to TP3 is used in the first three steps (the first image display step, the first image erasing step, and the first single-color display step). Then, in the first afterimage erasing step and the second afterimage erasing step, the drive pulse signal adjusted to TP4 is used. A DC balance is struck in the first three steps, and a DC balance is also struck in the first afterimage erasing step and the second afterimage erasing step, in which the mutually inverse single-color displays are carried out, as described earlier. For this reason, a DC balance is struck in the five steps in FIGS. 13A to 13E.

After the execution of the second image erasing step in FIG. 13E, all of the pixels of the display unit 3 will be displayed in white. Next, the second iteration of the first image display step is executed. That is to say, in a case where there is a change in temperature after the first image display step and before the first image erasing step, a subsequent iteration of the first image display step is executed without the second image display step and second image erasing step having been executed.

As per the foregoing, the method for driving an electrophoretic display device of the present embodiment makes it possible, even in a case where there is a change in temperature after the first image display step and before the first image erasing step, to also compensate for the effects of a change in temperature (more specifically, an afterimage such as that in FIG. 13B) while still striking a DC balance. For this reason, the long-term reliability can be ensured, and the display quality is enhanced. Also, because the partial drive format is still used, it is possible to shorten the refresh time for an image in comparison to a case where solely the full-screen drive format is used. FIGS. 13F to 13G correspond to cases in which the first image is the time display "10:06" in FIGS. 13A to 13B, respectively, and thus a description thereof has been omitted.

1.6. Flow Chart

Figure 15:
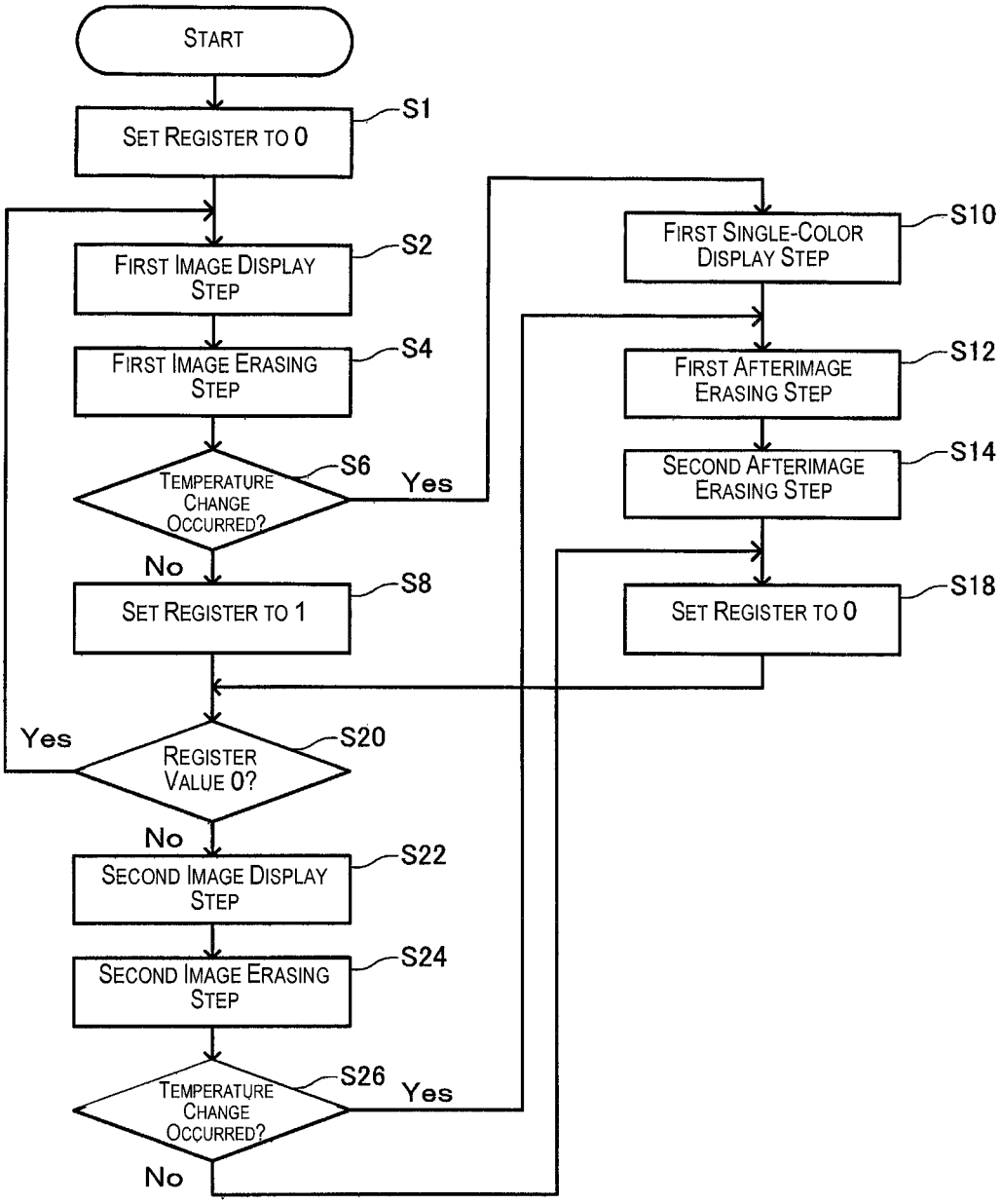
FIG. 15 is a flow chart of the first embodiment.

The display examples of the present embodiment were represented by dividing cases between whether or not there was a change in temperature; the flow chart in FIG. 15 offers a summary of the control processing carried out by the control unit of the electrophoretic display device of the present embodiment. The control unit of the electrophoretic display device herein has a register in which "1" is set in a case where it is necessary to execute the second image display step and the second image erasing step. The description in the flow chart of FIG. 15 assumes that this register is referred to simply as a "register".

First, the register is set to "0" to initialize the register (S1). The first image display step (S2), in which the first image (for example, in the example in FIG. 8A, the time display "10:05") is displayed in the first color (for example, black), is then executed. Thereafter, the first image erasing step (S4), in which the entirety of the display unit is set to the first color by displaying the background of the first image in the first color, is executed.

Herein, the register is set to "1" (S8) in a case where the temperature detection unit does not detect the predetermined change in temperature (for example, a change in temperature of such an extent that a difference of two stages is produced in the table in FIG. 9) after the first image display step and before the first image erasing step (S6: No).

In a case where the temperature detection unit does detect the predetermined change in temperature after the first image display step and before the first image erasing step (S6: Yes), however, then the first single-color display step is executed (S10) and all of the pixels of the display unit 3 are displayed in the second color (white). In the first single-color display step, a drive pulse signal that has been adjusted on the basis of the temperature before the change is used.

Thereafter, the first afterimage erasing step (S12) and the second afterimage erasing step (S14) are executed using a drive pulse signal that has been adjusted on the basis of the temperature after the change, whereby the afterimage caused by the change in temperature is erased. At this time, for example, the entirety of the display unit can be displayed in black in the first afterimage erasing step, the entirety of the display unit then also being displayed in white in the second afterimage erasing step (see FIGS. 13D to 13E). Thereafter, the register is set to "0" (S18).

In the present embodiment, the partial drive format is used in the first afterimage erasing step (S12) and the second afterimage erasing step (S14) as well. However, the full-screen drive format can also be used for the first afterimage erasing step and the second afterimage erasing step. In such a case, for any desired image, a normal display and an inverse display would be executed in the first afterimage erasing step and the second afterimage erasing step. For this reason, an image other than a single-color display can be used without the need to increase the number of steps.

After the steps S18 and S18, a determination is made as to whether or not the value of the register is "0" (S20). When the value of the register is "0", then there is no need to execute the second image display step and the second image erasing step, and thus the flow returns to the first image display step (S2) (S20: Yes). When the value of the register is "1" (S20: No), however, then there has been no change in temperature after the first image display step and before the first image erasing step, and therefore the second image display step (S22) and the second image erasing step (S24) are executed.

The second image display step causes the background of the second image (for example, in the example in FIG. 8C, the time display "10:06") to be displayed in the second color (for example, white). The second image erasing step sets the entirety of the display unit to the second color by displaying the second image in the second color.

In a case herein where the temperature detection unit does not detect the predetermined change in temperature after the second image display step and before the second image erasing step (S26: No), then the register is set to "0" (S18) and the determination of the value of the register (S20) is executed.

In a case where the temperature detection unit does detect the predetermined change in temperature after the second image display step and before the second image erasing step (S26: Yes), however, then the afterimage caused by the change in temperature is erased by the execution of the first afterimage erasing step (S12) and the second afterimage erasing step (S14) using a drive pulse signal that has been adjusted on the basis of the temperature after the change. After the second afterimage erasing step (S14) has been executed, the register is set to "0" (S18) and the determination of the value of the register (S20) is executed.

In this manner, in the method for driving an electrophoretic display device in the present embodiment, a DC balance is struck irrespective of whether or not there has been a change in temperature, and in a case where a change in temperature has taken place, then the afterimage caused by the change in temperature is erased by the execution of the first afterimage erasing step and the second afterimage erasing step in which the drive pulse signal that has been adjusted on the basis of the temperature after the change is used. For this reason, the long-term reliability can be ensured, and the display quality is enhanced. Also, because the partial drive format is still used, it is possible to shorten the refresh time for an image in comparison to a case where solely the full-screen drive format is used.

2. Second Embodiment

The second embodiment of the invention shall now be described, with reference to FIGS. 16A to 20. Like elements to those in FIGS. 1 to 15 have been assigned like reference numerals, and a description thereof has been omitted. In the second embodiment, unlike the first embodiment, a second single-color display step is executed after the second afterimage erasing step. For this reason, even in a case where a DC balance is not struck in the first afterimage erasing step and the second afterimage erasing step, more specifically, even when these steps are for displaying an image other than a single-color display in the partial drive format, it is still possible overall to strike a DC balance and to compensate for the effects of a change in temperature as well.

The configuration of the electrophoretic display device of the second embodiment is the same as that of the first embodiment as well, and thus a description thereof has been omitted. The circuitry configuration of the pixel portion, the display format, and the like are also the same as those of the first embodiment. In the method for driving an electrophoretic display device of the present embodiment, the first afterimage erasing step and the second afterimage erasing step use the partial drive format, and an image other than a single-color display is employed as a predetermined image. In, for example, a checkered pattern of several dots including the first color and the second color, the direction of the electric field is different during driving for every several dots. When a normal display and an inverse display are executed using an image of a checkered pattern, there is the possibility of being able to enhance the effect of erasing the afterimage in comparison to a case where a single-color display is used. In the present embodiment, an image other than a single-color display is used in order to enhance the effect of afterimage erasing.

FIGS. 16A to 17B are examples of the predetermined image that is used in the first afterimage erasing step and the second afterimage erasing step. For example, a normal checkered pattern such as in FIG. 16A can be used in the first afterimage erasing step, an inverse checkered pattern such as in FIG. 16B then being used in the second afterimage erasing step. As another example, a normal houndstooth check such as in FIG. 17A can be used in the first afterimage erasing step, an inverse houndstooth check such as in FIG. 17B then being used in the second afterimage erasing step.

Figure 16A:
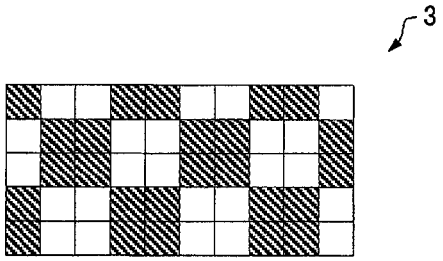
FIGS. 16A to 16B are examples of an image used in a first afterimage erasing step and a second afterimage erasing step in a second embodiment.
Figure 16B:
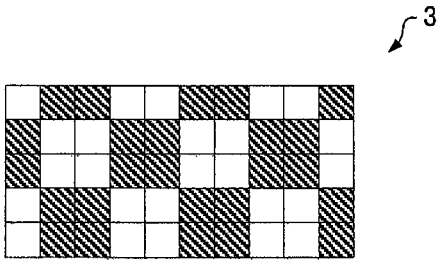
Figure 17A:
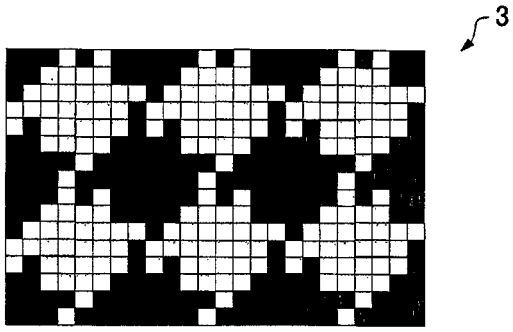
FIGS. 17A to 17B are other examples of an image used in the first afterimage erasing step and the second afterimage erasing step in the second embodiment.
Figure 17B:
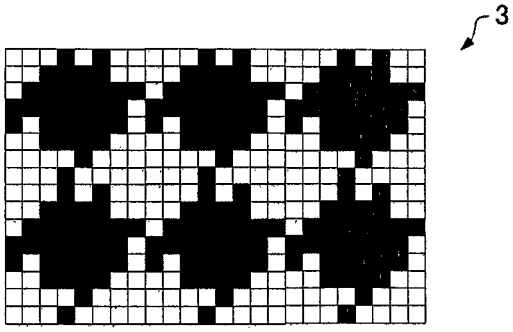

The understanding herein is that, for example, the portion that is black in the checkered pattern in FIG. 16A is displayed in black in the first afterimage erasing step, and the portion that is black in the checkered pattern in FIG. 16B is complementarily displayed in black in the second afterimage erasing step. In such a case, the full screen of the display unit 3 is simply a black display after the execution of these steps, and a DC balance is not struck. Therefore, in the method for driving an electrophoretic display device of the present embodiment, the second single-color display step is executed after the second afterimage erasing step. The second single-color display step includes using a drive pulse signal that has been adjusted on the basis of the temperature after the change to cause all the pixels of the display unit to be displayed in the second color (i.e., white).

2.1. Display Example of the Present Embodiment

A display example of the present embodiment shall now be described, with reference to FIGS. 18A to 19. Herein, in order to avoid a redundant description, the description relates solely to a case where there has been a change in temperature after the first image display step and before the first image erasing step; however, the second single-color display step would also be identically executed in a case where there is a change in temperature after the second image display step and before the second image erasing step.

In a case where the predetermined change in temperature is detected after the first image display step and before the first image erasing step, a drive pulse signal that has been adjusted for the temperature after the change (TP4) is used to execute the first afterimage erasing step of FIG. 18D, the second afterimage erasing step of FIG. 18E, and the second single-color display step of FIG. 18F.

At this time, following the execution of the first afterimage erasing step and the second afterimage erasing step, the display will be black, as in FIG. 18E, and a DC balance is not struck. Therefore, the second single-color display step of FIG. 18F is executed, thus striking a DC balance among these three steps. The other steps are the same as the steps of the same names in, for example, FIGS. 13A to 13G in the first embodiment, and a description thereof has been omitted.

Figure 19:
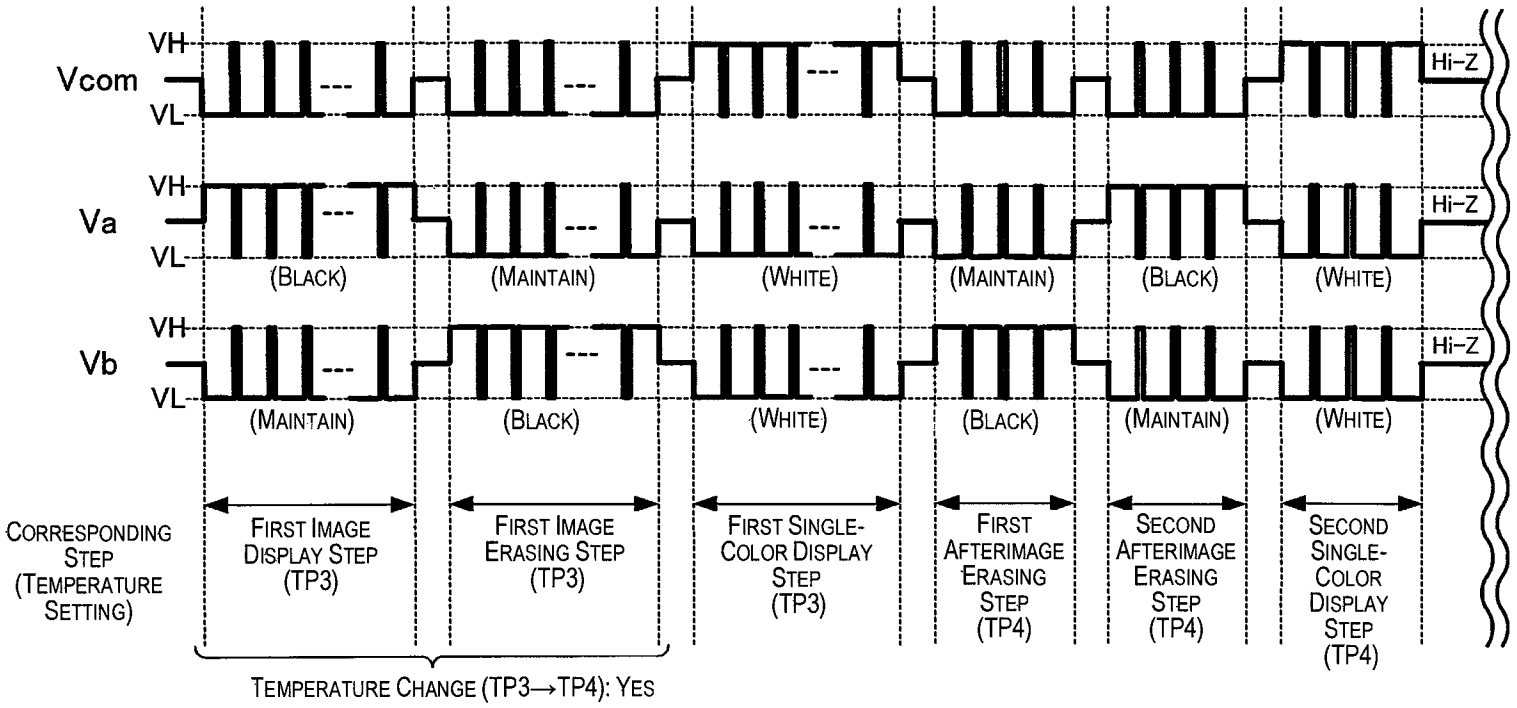
FIG. 19 is a drawing exemplifying changes in the voltage applied to an electrode in correspondence with the steps in FIGS. 18A to 18F.

FIG. 19 represents the drive pulse signals corresponding to the steps in FIGS. 18A to 18F, and the like. The drive pulse signal having been adjusted to TP3 is used in the first three steps (the first image display step, the first image erasing step, and the first single-color display step). However, the drive pulse signal having been adjusted to TP4 is used in the first afterimage erasing step, the second afterimage erasing step, and the second single-color display step. A DC balance is struck among the first three steps as well as among the remaining three steps. For this reason, a DC balance is struck among the six steps in FIGS. 18A to 18F.

As per the foregoing, in the method for driving an electrophoretic display device of the present embodiment, too, it is possible to compensate also for the effects of a change in temperature (more specifically, an afterimage such as in FIG. 18B), while still striking a DC balance. For this reason, the long-term reliability can be ensured, and the display quality is enhanced. At this time, it is possible to use any desired image other than a single-color display in the first afterimage erasing step and the second afterimage erasing step, and thus the effect of afterimage erasing can be enhanced.

2.2. Flow Chart

Figure 20:
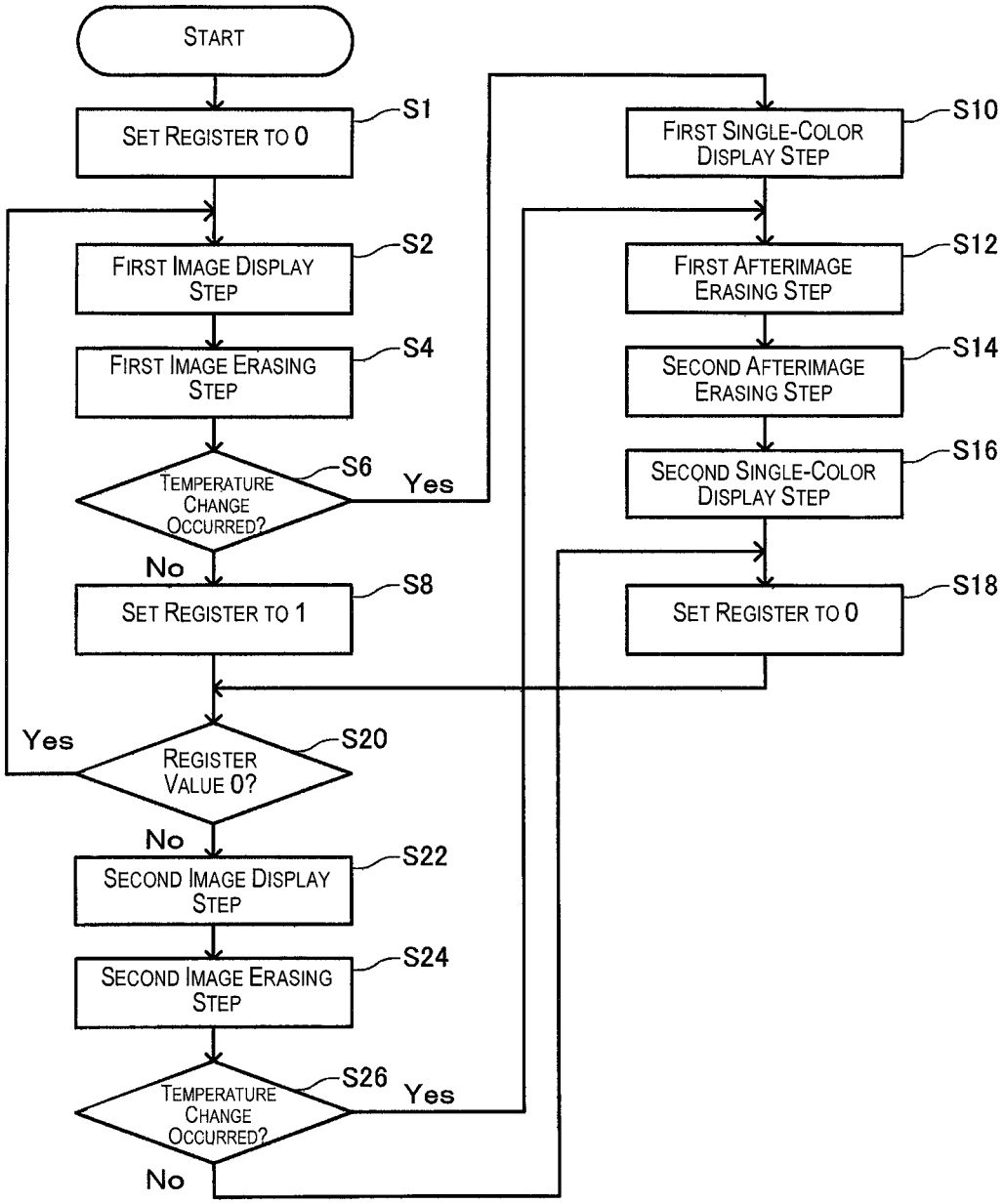
FIG. 20 is a flow chart of the second embodiment.

The flow chart in FIG. 20 offers a summary of the control processing carried out by the control unit of the electrophoretic display device of the present embodiment. Herein, the sole difference from the first embodiment resides in that the second single-color display step (S16) is executed after the second afterimage erasing step (S14). That is, merely adding one step makes it possible to use any desired image other than a single-color display in the first afterimage erasing step (S12) and the second afterimage erasing step (S14), and allows for an enhanced effect of afterimage erasing.

The other steps are the same as the steps to which like reference numerals were assigned in FIG. 15 of the first embodiment, and a description thereof has been omitted.

In this manner, in the method for driving an electrophoretic display device in the present embodiment, a DC balance is struck irrespective of whether or not there has been a change in temperature, and in a case where a change in temperature has taken place, then the afterimage caused by the change in temperature is erased by the execution of the first afterimage erasing step and the second afterimage erasing step in which the drive pulse signal that has been adjusted on the basis of the temperature after the change is used. At this time, there can be expected to be a higher effect of afterimage erasing. For this reason, the long-term reliability can be ensured, and the display quality is further enhanced. Also, because the partial drive format is still used, it is possible to shorten the refresh time for an image in comparison to a case where solely the full-screen drive format is used.

3. Application Example

An application example of the invention shall now be described with reference to FIGS. 21 to 22B. Like elements to those in FIGS. 1 to 20 have been assigned like reference numerals, and a description thereof has been omitted. The electrophoretic display devices of the first and second embodiments can be applied to an electronic apparatus such as, for example, an electronic timepiece for displaying the time.

3.1. Block Diagram of an Electronic Apparatus

Figure 21:
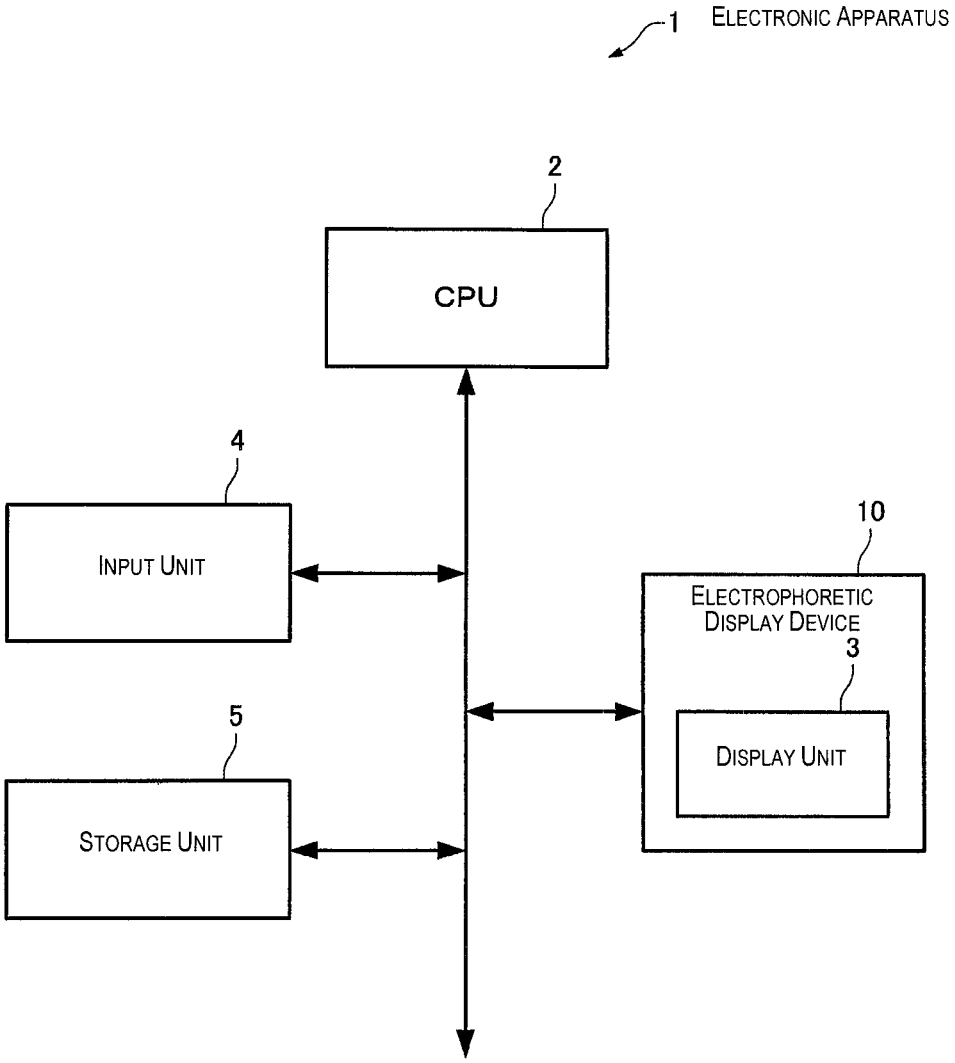
FIG. 21 is a block diagram of an electronic apparatus of an application example.

FIG. 21 is a block diagram of an electronic apparatus 1 as in an application example. The electronic apparatus 1 includes a CPU 2, an input unit 4, a storage unit 5, and the electrophoretic display device 10. The electrophoretic display device 10 is the electrophoretic display device of the first or second embodiment, and includes the display unit 3 for displaying a variety of images.

The CPU 2 controls the other blocks and carries out a variety of computations and processes. The CPU 2 can, for example, read a program from the storage unit 5 and input a time signal or the like to the electrophoretic display device 10 in conformity with the program.

The input unit 4 can, for example, accept an instruction from a user of the electronic apparatus 1 and output a signal corresponding to the instruction to the other blocks.

The storage unit 5 can, for example, be a memory such as a DRAM or SRAM, or can include a read-only memory (ROM). The program used by the CPU 2 can, for example, be written onto the ROM included by the storage unit 5.

The display unit 3 is a part of the electrophoretic display device 10 and can, for example, display the time, or display text, pictures, or the like.

By including the electrophoretic display device 10 of the first or second embodiment, the electronic apparatus 1 is able to erase the afterimage that can be produced in a case where a change in temperature has occurred, while still striking a DC balance. For this reason, an electronic apparatus 1 of excellent long-term reliability and favorable display quality can be realized.

3.2. Specific Example of an Electronic Apparatus

Figure 22A:
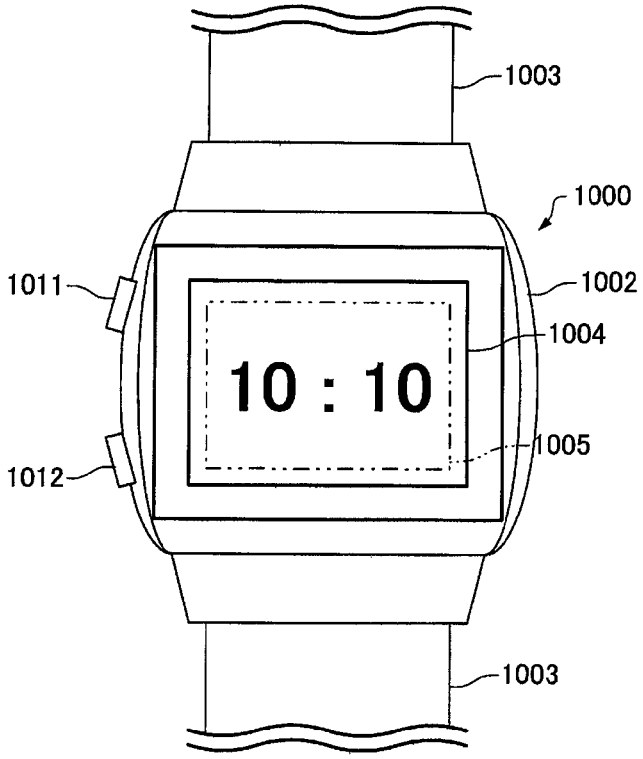
FIG. 22A is a drawing of an electronic timepiece, which is one example of an electronic apparatus.
Figure 22B:
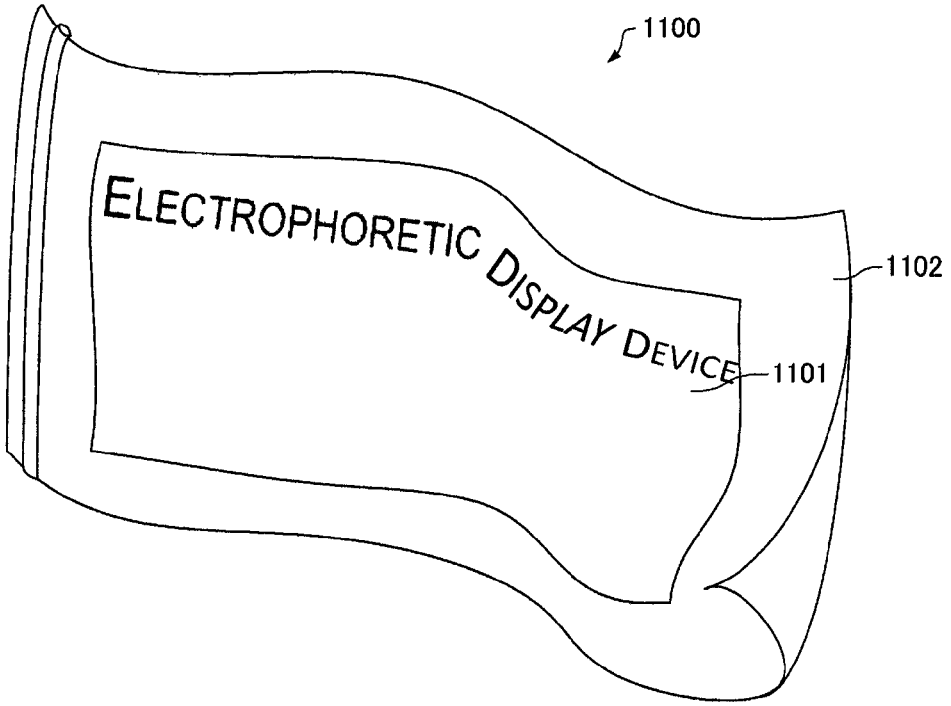
FIG. 22B is a drawing of electronic paper, which is one example of an electronic apparatus.

FIGS. 22A to 22B illustrate a specific example of an electronic apparatus. FIG. 22A is a front view of an electronic timepiece 1000, which is one such electronic apparatus. The electronic timepiece 1000 is, for example, a wristwatch, and is provided with a timepiece case 1002 and a pair of bands 1003 joined to the timepiece case 1002. A display unit 1004, which is the display unit 3 of the electrophoretic display device 10 (see FIG. 21) is provided to the front surface of the timepiece case 1002, and carries out a time display 1005. Two operation buttons 1011 and 1012 are provided to a side surface of the timepiece case 1002, and function as the input unit 4 (see FIG. 21).

FIG. 22B is a perspective view of an electronic paper 1100, which is one such electronic apparatus. The electronic paper 1100 is flexible, and is provided with a display region 1101, which is the display unit 3 of the electrophoretic display device 10 (see FIG. 21), as well as a main body 1102.

The electrophoretic display device of the first and second embodiments can be applied to a variety of electronic apparatuses, which include these specific examples. The electronic apparatus of such description, by striking a DC balance, can ensure the long-term stability of the display unit, and is also able to enhance the display quality because the afterimage that can be produced in a case where a change in temperature has occurred is erased.

4. Other

In the embodiments above, the electrophoretic display device is not limited to being one where a black-and-white two-particle system based on black particles and white particles is electrophoresed; instead, a single-particle system of blue-white can be electrophoresed, or color combinations other than black and white can be used.

There is also no limitation to being an electrophoretic display device; the method of driving described above can also instead be applied to a displaying means having the memory property. Examples include an electrochromic display (ECD), a ferroelectric liquid crystal display, a cholestric liquid crystal display, and the like.

The electronic timepiece of the application example described above is also not limited to being a wristwatch; application to a broad range of apparatuses having a timepiece function is possible, including a table clock, a wall clock, a pocket watch, and the like.

There is no limitation to these illustrative examples, and the invention includes any configuration substantially identical to a configuration described in the embodiments (for example, a configuration of identical functions, methods, and results, or a configuration of identical objectives and effects). The invention also includes any configuration in which the non-essential portions of a configuration described in the embodiments have been replaced. The invention further includes any configuration giving rise to the same effects as those of a configuration described in the embodiments, or any configuration making it possible to achieve the same objectives. The invention moreover includes any configuration obtained when a well-known feature is added to a configuration described in the embodiments.

What is claimed is:

1. A method for driving an electrophoretic display device, the display comprises;

a display unit in which electrophoretic elements comprising electrophoretic particles are sandwiched between a pair of substrates and which includes pixels capable of displaying at least a first color and a second color, pixel electrodes corresponding to the pixels disposed between the substrates and the electrophoretic elements, a common electrode that faces the plurality of pixel electrodes disposed between the other of the substrates and the electrophoretic elements, and a temperature detection unit configured to measure a temperature of the display unit, and the method comprising:

causing the display unit to display a first image in the first color by a partial drive format, in which a voltage based on a drive pulse signal repeating a first electric potential and a second electric potential is applied to the common electrode and a voltage based on a normal signal or an inverse signal of the drive pulse signal is applied to each of the plurality of pixel electrodes, thus causing the electrophoretic particles to be moved by an electric field produced between the pixel electrodes and the common electrode;

causing the display unit to display a background of the first image in the first color by the partial drive format, after the causing the display unit to display the first image in the first color;

causing the display unit to display a background of a second image in the second color, by the partial drive format; and causing the display unit to display the second image in the second color by the partial drive format, after the causing the display unit to display the background of the second image; and wherein in a case where the temperature detection unit detects a predetermined change in temperature after the causing the display unit to display the background of the second image and before the causing the display unit to display the second image in the second color, causing the display unit to display a predetermined image by using the drive pulse signal adjusted on the basis of the temperature after the change, and causing the display unit to complementarily display the predetermined image by using the drive pulse signal adjusted on the basis of the temperature after the change, are executed after the causing the display unit to display the second image in the second color, and a subsequent iteration of the causing the display unit to display the first image in the first color is executed after the causing the display unit to complementarily display the predetermined image.

2. The method for driving an electrophoretic display device as set forth in claim 1, wherein:

in a case where the temperature detection unit detects the predetermined change in temperature after the causing the display unit to display the first image in the first color and before the causing the display unit to display the background of the first image, causing all the pixels of the display unit to be displayed in the second color by using the drive pulse signal, which has been adjusted on the basis of the temperature before the change, the causing the display unit to display the predetermined image and the causing the display unit to complementarily display the predetermined image are executed after the first image erasing step.

3. The method for driving an electrophoretic display device as set forth in claim 1, wherein:

the causing the display unit to display the predetermined image and the causing the display unit to complementarily display the predetermined image use a single-color display as the predetermined display.

4. The method for driving an electrophoretic display device as set forth in claim 1, wherein:

the causing the display unit to display the predetermined image and the causing the display unit to complementarily display the predetermined image use a display other than a single-color display as the predetermined display, and causing all the pixels of the display unit to be displayed in the second color by using the drive pulse signal, which has been adjusted on the basis of the temperature after the change, is executed after the causing the display unit to complementarily display the predetermined image.

5. The method for driving an electrophoretic display device as set forth in claim 4, wherein:

the causing the display unit to display the predetermined image and the causing the display unit to complementarily display the predetermined image use a checkered pattern as the predetermined display.

6. An electrophoretic display device, provided with a control unit for executing the method for driving an electrophoretic display device as set forth in claim 1.

7. An electronic apparatus, comprising the electrophoretic display device as set forth in claim 6.

8. An electronic timepiece, comprising the electrophoretic display device as set forth in claim 6.

9. A method for driving an electrophoretic display device, the display comprises;

a display unit in which electrophoretic elements comprising electrophoretic particles are sandwiched between a pair of substrates and which includes pixels capable of displaying at least a first color and a second color, pixel electrodes corresponding to the pixels disposed between one of the substrates and the electrophoretic elements, a common electrode that faces the plurality of pixel electrodes disposed between the other of the substrates and the electrophoretic elements, and a temperature detection unit configured to measure a temperature of the display unit, and the method comprising:

causing the display unit to display a first image in the first color by a partial drive format, in which a voltage based on a drive pulse signal repeating a first electric potential and a second electric potential is applied to the common electrode and a voltage based on a normal signal or an inverse signal of the drive pulse signal is applied to each of the plurality of pixel electrodes, thus causing the electrophoretic particles to be moved by an electric field produced between the pixel electrodes and the common electrode; and causing the display unit to display a background of the first image in the first color by the partial drive format, after the causing the display unit to display the first image in the first color; and wherein in a case where the temperature detection unit detects a predetermined change in temperature after the causing the display unit to display the first image in the first color and before the causing the display unit to display the background of the first image in the first color, causing all the pixels of the display unit to be displayed in the second color by using the drive pulse signal adjusted on the basis of the temperature before the change, causing the display unit to display a predetermined image by using the drive pulse signal adjusted on the basis of the temperature after the change, and causing the display unit to complementarily display the predetermined image by using the drive pulse signal adjusted on the basis of the temperature after the change, are executed after the causing the display unit to display the background of the first image in the first color, and a subsequent iteration of the causing the display unit to display the first image in the first color is executed after the causing the display unit to complementarily display the predetermined image.

* * * * *